US006796519B1

(12) United States Patent
Knobbe et al.

(10) Patent No.: US 6,796,519 B1
(45) Date of Patent: Sep. 28, 2004

(54) POWDER SPRAY GUN

(75) Inventors: Alan J. Knobbe, Loveland, OH (US); Andrew M. Peddie, North Royalton, OH (US); John B. Wolanin, Brunswick, OH (US); John C. A. Traylor, Elyria, OH (US); Bryan J. Bowman, Indianapolis, IN (US); Paul F. Meyers, Indianapolis, IN (US); Daniel J. Thompson, Vermilion, OH (US); Joseph G. Schroeder, North Royalton, OH (US)

(73) Assignee: Nordson Corporation, Westlake, OH (US)

( * ) Notice: Subject to any disclaimer, the term of this patent is extended or adjusted under 35 U.S.C. 154(b) by 0 days.

(21) Appl. No.: 09/667,663

(22) Filed: Sep. 22, 2000

Related U.S. Application Data

(63) Continuation-in-part of application No. 09/490,099, filed on Jan. 31, 2000.
(60) Provisional application No. 60/154,295, filed on Sep. 16, 1999.

(51) Int. Cl.[7] ..... B05B 5/00
(52) U.S. Cl. ..... 239/690; 239/697; 239/600; 138/110; 248/49; 248/75
(58) Field of Search ..... 239/690–708, 239/600; 248/49, 51, 65, 75; 138/110, 106

(56) References Cited

U.S. PATENT DOCUMENTS

| | | | | |
|---|---|---|---|---|
| 2,058,752 A | * | 10/1936 | Wray | 348/65 |
| 2,147,124 A | * | 2/1939 | Litle, Jr. | 138/110 |
| 2,356,944 A | | 8/1944 | Peeps | |
| 2,774,625 A | | 12/1956 | Hawley et al. | |
| 2,964,248 A | | 12/1960 | O'Brien et al. | |

(List continued on next page.)

FOREIGN PATENT DOCUMENTS

| | | |
|---|---|---|
| DE | 19709786 A1 | 2/1998 |
| EP | 0553052 B1 | 12/1996 |
| EP | 1084759 A2 | 3/2001 |
| EP | 1084759 A3 | 7/2002 |
| FR | 1028824 | 5/1953 |
| FR | 2326984 | 5/1977 |
| GB | 986026 | 3/1963 |

*Primary Examiner*—Dinh Q. Nguyen
(74) *Attorney, Agent, or Firm*—Calfee, Halter & Griswold LLP

(57) ABSTRACT

An electrostatic spray gun apparatus includes a spray gun housing and a nozzle attached to a spray end of the housing, and a powder path that extends in a substantially straight line along an axis of the housing from the powder inlet to the powder outlet. The powder path is in the form of an enclosed smooth powder passage that is substantially continuous and Pierce uninterrupted from the powder inlet to the powder outlet to eliminate substantially all recesses or gaps that could capture or trap powder. The powder passage is formed by a plurality of tubular segments that are aligned along the housing axis and abut end to end, that when assembled in the housing axially compress the segments together to substantially eliminate dead spots or recesses to form the continuous smooth powder path. A gun purge function is provided that allows a purge line to be installed on the gun assembly. A cartridge valve and conductor assembly is provided between the gun electrode in the nozzle and the output of the voltage multiplier. The cartridge includes a conductive path to provide electrical continuity from the multiplier to the gun electrode, and also includes valve, preferably in the form of a stem check valve, that closes when the gun electrode is removed or at least unseated from the nozzle. The gun also includes a tube mount arrangement wherein the tube mount is rigidly held together with the gun housing in axial compression by a tie bar.

15 Claims, 29 Drawing Sheets

U.S. PATENT DOCUMENTS 3,411,715 A * 11/1968 Wallis ..... 239/700
3,590,318 A 6/1971 Probst et al.
3,682,384 A * 8/1972 Suisse ..... 239/697
3,746,254 A * 7/1973 Duncan et al. ..... 239/15
3,853,148 A * 12/1974 De Vincent et al. ..... 138/110
4,138,161 A 2/1979 Payne
4,151,864 A * 5/1979 Thurman ..... 138/110
4,320,783 A * 3/1982 Neal et al. ..... 138/110
4,399,945 A * 8/1983 Ruud ..... 239/697
4,613,083 A 9/1986 Mulder et al.
4,630,777 A 12/1986 Hollstein et al.
4,729,513 A 3/1988 Fetcenko et al.
4,815,666 A 3/1989 Gacka et al.
4,830,279 A 5/1989 Crum et al.
4,937,417 A * 6/1990 Fox ..... 219/76.1
5,022,590 A 6/1991 Buschor et al.
5,029,755 A * 7/1991 Schmidt et al. ..... 239/305
5,056,720 A * 10/1991 Crum et al. ..... 239/698
5,402,940 A 4/1995 Haller et al.
5,454,256 A 10/1995 Gimben et al.
5,482,556 A 1/1996 Shutic et al.
5,678,770 A 10/1997 Shah
5,759,271 A 6/1998 Buschor
5,765,971 A 6/1998 Rutz
5,947,396 A 9/1999

* cited by examiner

POWDER SPRAY GUN

RELATED PATENT APPLICATION

This application is a continuation-in-part of co-pending U.S. patent application Ser. No. 09/490,099 for POWDER SPRAY GUN filed on Jan. 31, 2000 which application claims the benefit of U.S. Provisional Patent Application No.: 60/154,295 filed on Sep. 16, 1999 for POWDER SPRAY GUN, the entire disclosures of which are fully incorporated herein and by reference.

FIELD OF THE INVENTION

The present invention is directed to the art of spraying powder coating materials. More particularly, the invention is directed to a spray gun that is easy to clean internally and externally by substantially eliminating gaps and surfaces that can collect or trap powder.

BACKGROUND OF THE INVENTION

Powder coating materials may be applied to any number of objects and surfaces by spraying. A commonly used spraying technique is electrostatic spraying with an electrostatic spray gun. In such a spraying apparatus, the spray gun typically includes a spray nozzle through which powder is ejected toward a target surface or object to be coated with the powder. Oftentimes, the object or surface is placed in a powder spray booth to constrain the powder within a confined area and to facilitate recovery of powder overspray.

Powder is fed to the gun from a powder supply, typically a powder feed hopper that may include a fluidized powder bed. The powder is fluidized in the hopper by a flow of air through the floor of the hopper. One or more powder pumps may be used to pump the fluidized powder from the hopper to one or more spray guns through a corresponding number of powder feed hoses. Such a powder spray apparatus is described in U.S. Pat. No. 5,454,256, which is assigned to the assignee of the present invention and is fully incorporated herein by reference. These are exemplary systems, however, and those skilled in the art will readily appreciate that the present invention can be used with a wide variety of powder spray apparatus.

Electrostatic powder spraying can be implemented in a number of ways. For purposes of the present invention, an electrostatic spray gun of particular interest is corona charging in which an electrostatic charge is applied to the powder being sprayed by exposing the powder to a corona or ion bombardment at the nozzle. This ion bombardment occurs when the electric field is high enough at the electrode to ionize air molecules. The electric field is produced by the electrode that is disposed at the nozzle and that is connected to a high voltage source, commonly referred to as a voltage multiplier. The target object or surface is held at an electrical potential relative to the electrode, typically ground, and the charged powder particles are attracted to and readily adhere to the target surface. Thus, a typical electrostatic corona charging powder spray gun includes an electrical power input cable, a powder hose and may further include an air line for purge air, all connectable to the back end of the spray gun.

A common problem with electrostatic spraying apparatus is the time and labor consuming task of color changeover. Powder coatings are characteristically made up of powder particles on the order of about thirty (30) microns in size, and in many cases can be substantially smaller. These small particles can easily find their way into various gaps and recesses within a spray gun housing, especially with the use of air pressure to force the powder through the gun housing and nozzle. In order to switch a gun from spraying a first powder color to another, as much of the first powder must be cleaned and removed from the gun as possible; otherwise, residual first powder color particles can mix with and contaminate the spray of the second powder color during subsequent use of the spray gun. It is also a common maintenance activity to clean a spray gun to remove excess powder from within the gun to prevent caking and clogging. Accordingly, it is typical for both routine maintenance and during color changeover to use air to blow off powder from various parts of the spray gun, both within the gun interior and that which may have collected on the gun exterior housing and supply lines.

Known electrostatic powder spray gun apparatus do not effectively prevent the entrapment or collection of powder within the gun assembly. This results in the time consuming and costly need to disassemble the gun in order to blow away the trapped powder and subsequent re-assembly of the gun components. Known gun apparatus also do not allow for gun purging with air through the powder path through the gun as part of routine maintenance and color changeover. Still further, the increasing use of spray booths for confining and recovering powder overspray has resulted in a need for better and easier gun mounting arrangements while still permitting fast and effective cleaning and color changeover.

Accordingly, it is an objective of the invention to provide a powder spray gun that can quickly and easily be cleaned both for maintenance and color changeover. Such a gun preferably will have minimal or negligible recesses or dead spots that can trap powder within the spray gun. Preferably, such a spray gun can also include an optional automatic gun purging function to assist in the cleaning operation. It is also an objective of the present invention to provide improved gun mounting arrangements while maintaining ease of assembly and color changeover and maintenance cleaning.

SUMMARY OF THE INVENTION

To the accomplishment of the foregoing objectives and others, the present invention provides in a first embodiment an electrostatic spray gun apparatus having a spray gun housing, a nozzle attached to a spray end of the housing, the nozzle having an electrode therein for electrostatically charging the powder, and a powder outlet through which powder is ejected towards a target surface to be powder sprayed, a powder supply or feed hose connectable to the housing at an inlet end thereof, and a powder path that extends in a substantially straight line along an axis of the housing from the powder inlet to the powder outlet. In accordance with one aspect of the invention, the powder path is realized in the form of an enclosed smooth powder passage that is substantially continuous and uninterrupted from the powder inlet to the powder outlet to eliminate substantially all recesses or gaps that could capture or trap powder. In a preferred form, the powder passage includes a plurality of tubular segments that are aligned along the housing axis and abut end to end. Still further preferred, these powder passage segments are held together in axial alignment by externally threaded connectors that when assembled in the housing axially compress the segments together to substantially eliminate dead spots or recesses to form the continuous smooth powder path.

In accordance with another aspect of the invention, a gun purge function is provided in the form of an adapter kit that allows a purge line to be installed on the gun assembly. This purge feature can alternatively be a standard feature of the gun, but as an optional feature it increases the flexibility of the gun design for the user. This gun purge feature assists in the cleaning and maintenance operations as well as facilitating color changeover. In accordance with a preferred embodiment of the purge function, the purge inlet connection is rotatable about the longitudinal axis of the gun housing in order to allow the purge inlet to be positioned so as not to interfere with other gun components.

In accordance with another aspect of the invention, with the use of a straight powder path, the spray gun voltage multiplier is mounted off axis with respect to the gun housing longitudinal axis. Accordingly, the multiplier is electrically connected to the gun electrode via a conductor that is angled toward the nozzle from the multiplier. In order to permit easy removal of the electrode for cleaning the gun interior, a conductor cartridge is provided between the gun electrode in the nozzle and the output of the voltage multiplier. In accordance with a further aspect of the invention, the conductor cartridge includes a valve, preferably in the form of a stem check valve, that closes when the gun electrode is removed or at least unseated from the nozzle. This valve when closed prevents powder from being blown into the gun housing and in particular toward the voltage multiplier. When open, the valve permits conventional air washed electrode operation.

In accordance with another aspect of the invention, improved gun mounting arrangements are provided. In one embodiment, a ball style bar mount is provided that permits the mounted gun to be oriented along two independent axes, for example, by rotating the gun about the vertical and horizontal axes. In another embodiment, the invention provides a tube mount arrangement in which an elongated mount tube extends from the rear of the spray gun to a mounting arrangement at the rear of the overall assembly. In a preferred form, the tube mount is rigidly held together with the gun housing in axial compression by a tie bar. This arrangement provides a very rigid and secure structure that will not loosen during vibration and normal spraying operations. Further, this arrangement facilitates fast and simple assembly and disassembly for repair and maintenance.

Various other embodiments of the invention are described and claimed herein, and other features and advantages of the present device will become apparent from the following detailed description, with reference to the accompanying drawings and claims, which form a part of the specification.

DETAILED DESCRIPTION

I. General Powder Spray System

Figure 1:
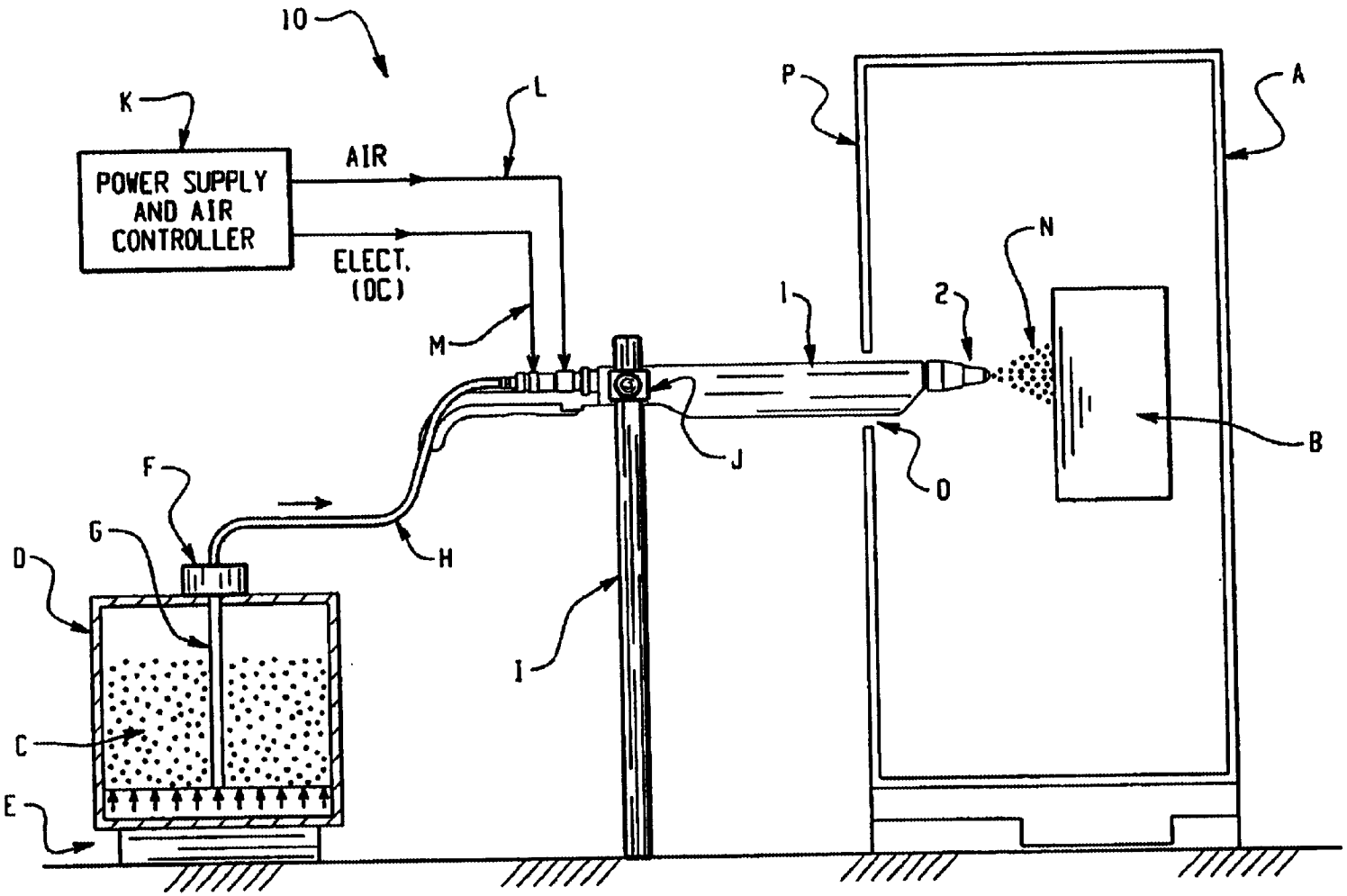
FIG. 1 is a simplified schematic representation of a powder spray system incorporating the present invention.

With reference to FIG. 1, the present specification relates to powder spray gun systems. The powder spray system 10 illustrated in FIG. 1 is intended to be exemplary in nature and should not be construed as limiting the scope of the present invention. Although the invention is described herein in the context of a high voltage electrostatic powder spray gun, those of ordinary skill in the art will readily understand and appreciate that many aspects and advantages of the present invention can be realized in many different types of powder spray systems. Accordingly, examples herein of specific applications of the invention should be construed as representative in nature and not limiting as to the scope of the invention.

A typical powder spray system 10 includes a powder spray booth A that is used to enclose an object or surface B that is to be sprayed with a powder C. Many different configurations for the spray booth A can be used and the particular spray booth selected forms no particular part of the present invention other than as part of an overall powder spray system that includes one or more of the inventive aspects of the present invention. An exemplary spray booth A is the Excel 2001 available from Nordson Corporation, Amherst, Ohio. All of the system components of the exemplary spray system 10 are commercially available from Nordson Corporation.

The system 10 further includes a supply of powder C to be applied to the object B. The powder C may be held in a feed hopper D, which may be a main feed hopper or a hopper that is supplied powder from a main hopper (not shown). The hopper D typically includes a fluidizing bed E that provides a source of air through a porous floor in the hopper D to fluidize the powder, as is well known to those skilled in the art. An exemplary hopper is model no. HR-2-50 feed hopper available from Nordson.

A powder pump F is used to draw powder from the hopper D up through a suction tube G and out a powder feed hose or line H. The pump F may be any design conveniently available, such as a Venturi type pump, Nordson model 100 Plus. The powder feed hose H is connectable to a powder spray gun 1 which will be described in detail hereinafter. Although the system 10 is illustrated as including a single gun 1 and supply system F and H, this is for clarity and ease of illustration. Those skilled in the art will readily understand that there may be, and typically are, a plurality of hoppers, pumps, powder lines and spray guns for a single spray booth or a plurality of spray booths.

The powder spray gun 1 may be conveniently mounted on any support arrangement suitable for positioning the gun relative to the object to be sprayed. In the illustrated embodiment, the gun 1 is mounted on a support bar I by a conventional clamping mechanism J. The gun 1 illustrated in FIG. 1 is a first embodiment of a gun in accordance with the present invention and is referred to herein as a "tube mount" version for reasons that will be apparent hereinafter. The invention also provides a "bar mount" version that will also be described herein and uses a ball style mounting arrangement (see FIG. 8). In either the tube mount or bar mount version, the gun 1 may be mounted on a stationary platform or support as illustrated in FIG. 1, or alternatively may be mounted on a gun mover, reciprocator or other support system (not shown) as required.

A conventional control system K may be used to control operation of the gun 1, such as Nordson model Versa-Spray II IPS Control Module. The control system K controls a supply of air to the gun via an air line L and also atomizing and flow air to the pump F, as well as electrical power via a power cable M. The air is used for cooling the gun 1 interior, and in particular the high voltage multiplier and for air washing the electrode as are well known to those skilled in the art. In accordance with a significant aspect of the invention, air can also be provided to the gun to effect an automatic gun purge function when an optional air purge kit is incorporated into the gun 1, as will be described hereinafter. The air can also be fed to a hand held air nozzle that can be used to blow powder off the gun exterior and also to blow powder off various gun parts during maintenance or color changeover, as will be explained herein.

The forward end of the gun 1 includes a nozzle assembly 2. In use, the gun 1 is positioned appropriately so that a powder spray N is directed toward the object B. Typically the gun 1 is positioned in the spray booth A via a port or opening O in a booth wall P. In the exemplary embodiments herein, the gun 1 is an electrostatic spray gun that applies an electrostatic charge to the powder as the powder exits the gun at the nozzle end. However, many aspects of the present invention will be readily understood as applying to other gun configurations. For example, the new ball mounting arrangement, gun purge option, gap free powder path and the tube mount configuration can be used with a wide variety of gun types.

A significant problem that the present invention alleviates is the problem of being able to clean the gun 1, especially the interior parts of the gun that are exposed to the powder. The powder C is transported through the gun 1 through a number of conduits or tubular members that collectively define a powder path. Powder can collect in the smallest of recesses and gaps within the gun 1 along the powder path and eventually can build up and cause a variety of problems as is well known to those skilled in the art. If the powder path is not gap free, powder can also find its way into various interior regions of the gun where its presence is undesirable, such as in the region of the voltage multiplier; or powder can even escape to atmosphere. Being able to effectively clean the gun interior of powder is also of significant importance when implementing a powder color changeover. The powder itself is easy to changeover simply by disconnecting the powder feed hose H from the gun and wheeling in another feed hopper and feed hose containing powder of a different color. However, it is important that the old color powder be eliminated from the gun 1 powder path and interior, otherwise the old color powder may mix in with the new color powder and compromise the quality of subsequent spraying operations.

The present invention addresses the problem of cleanability and color changeover in a variety of ways all of which can be used individually or in combination with one or more of the other features. These features include a straight line, smooth and gap free powder path from the powder inlet end of the gun 1 to the nozzle assembly 2 outlet. By providing a tight, straight and gap free powder path, powder is constrained within the gun and will not enter areas within the gun interior that are difficult to clean. The gap free powder path also increases the effectiveness of a gun purge feature provided with the present invention. This purge feature can be automatically controlled by the gun control function K when the optional purge kit is incorporated onto a selected gun. The purge feature can also be used as a standard feature of the gun as distinguished from being an optional add-on kit. However, the invention provides for an optional kit if desired or required because the kit allows for easier custom configurations for different customers with very few part changes needed.

Another aspect of the gun 1 in accordance with the invention that improves cleanability and color changeover is the provision of a mount tube housing extension and tie bar that greatly simplifies gun assembly and disassembly for maintenance and repair, while at the same time providing a very strong and rigid gun assembly that will not be susceptible to vibration and loosening.

Still a further aspect of the invention that improves cleanability and color changeover is the provision of a check valve that blocks powder from reaching the voltage multiplier and gun 1 interior during disassembly of the nozzle, and in particular during removal or replacement of the gun electrode assembly.

II. Tube Mount Configuration

Figure 2A:
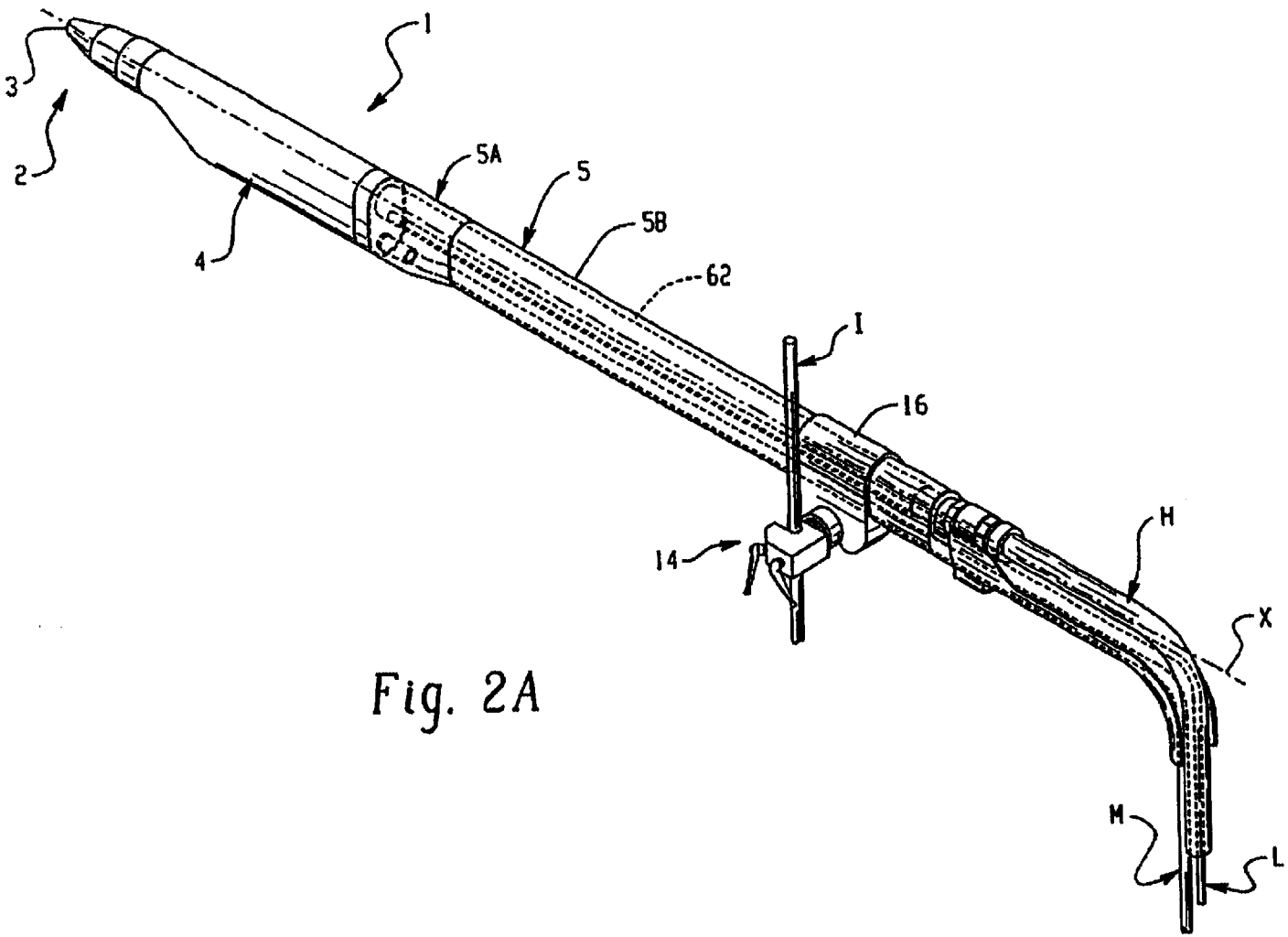
FIG. 2A is a perspective view of a first spray gun configuration referred to herein as a tube mount.

FIG. 2A illustrates a first embodiment of a spray gun 1 in accordance with the present invention. The gun 1 includes a nozzle assembly 2 having a powder spray outlet 3. The gun 1 is further defined by a main gun housing 4 that typically is an elongated structure along a longitudinal axis X of the gun 1. The gun housing 4 is used to enclose and support associated components of the spray gun 1, including among other things a gun electrode and a voltage multiplier that supplies a high voltage to the electrode for electrostatically charging the powder spray as it passes through and out the nozzle assembly 2.

Axially extending from the back end of the main housing 4 is a housing extension or mount tube 5. The mount tube 5 is illustrated in FIG. 2A as being a two piece assembly including a tube connector 5A and an extension 5B, but it is preferred to make the mount tube 5 a single unitary tubular structure, either by making the sections 5A and 5B a single piece or by permanently adhering the two pieces together as by gluing, for example. By making the mount tube effectively a single unitary piece, the overall gun 1 is a significantly more rigid and stable assembly, as will be further explained hereinafter.

The mount tube 5 may be any length in order to allow the gun 1 to be properly positioned for a particular spraying operation within the spray booth A. Typical lengths are two, three and four feet, for example, but the mount tube 5 can be made to any desired length. The nozzle assembly 2 and the housings 4 and 5 are preferably but not necessarily made of a suitable strong plastic material. The main gun housing 4 typically is about ten inches in length. The mount tube 5 is held in axial compression against the gun housing 4 by operation of a tie bar, as will be described in greater detail hereinafter. The tie bar concept allows for easy and fast assembly and disassembly of the gun 1 for maintenance and repair, while maintaining a strong and rigid assembly during spraying operations.

The mount tube 5 encloses a number of supply lines that are routed to the gun 1 from the control system K and the feed hopper D (FIG. 1). These supply lines include a powder feed tube 62 and the electric power cable M and the air line L (not shown in FIG. 2A). The mount tube extension portion 5B may, if desired, be made oval and compact as illustrated. Since the gun 1 also houses the multiplier, it tends to be somewhat oval and bulged in profile, therefore the connector portion 5A transitions the two oval parts 1 and 5B. Nothing prevents the use of a continuous size mount tube 5, however, if such is desired and there is no particular advantage to the illustrated tapered portion other than to save on material, cost and weight of the material used to form the mount tube 5. The mount tube 5 thus primarily is used for structural support of the gun 1 for a tube mount configuration, and also serves as a cover for the various individual supply lines that run to the spray gun 1.

The mount tube 5 is mounted on an adjustable bar clamp assembly 14. The bar clamp assembly 14 adjustably secures the gun assembly to the support bar I. The clamp assembly 14 permits selective Positioning of the gun assembly along the axial length of the support bar I; the clamp assembly further can be conventional in design and forms no particular part of the present invention. A mounting sleeve 16 is used to secure the gun assembly to the bar clamp assembly 14. Preferably, the sleeve 16 can be adjustably positioned along the length of the mount tube 5 for positioning the gun assembly relative to the spray booth A and the object being sprayed B.

III. Bar Mount Configuration

Figure 2B:
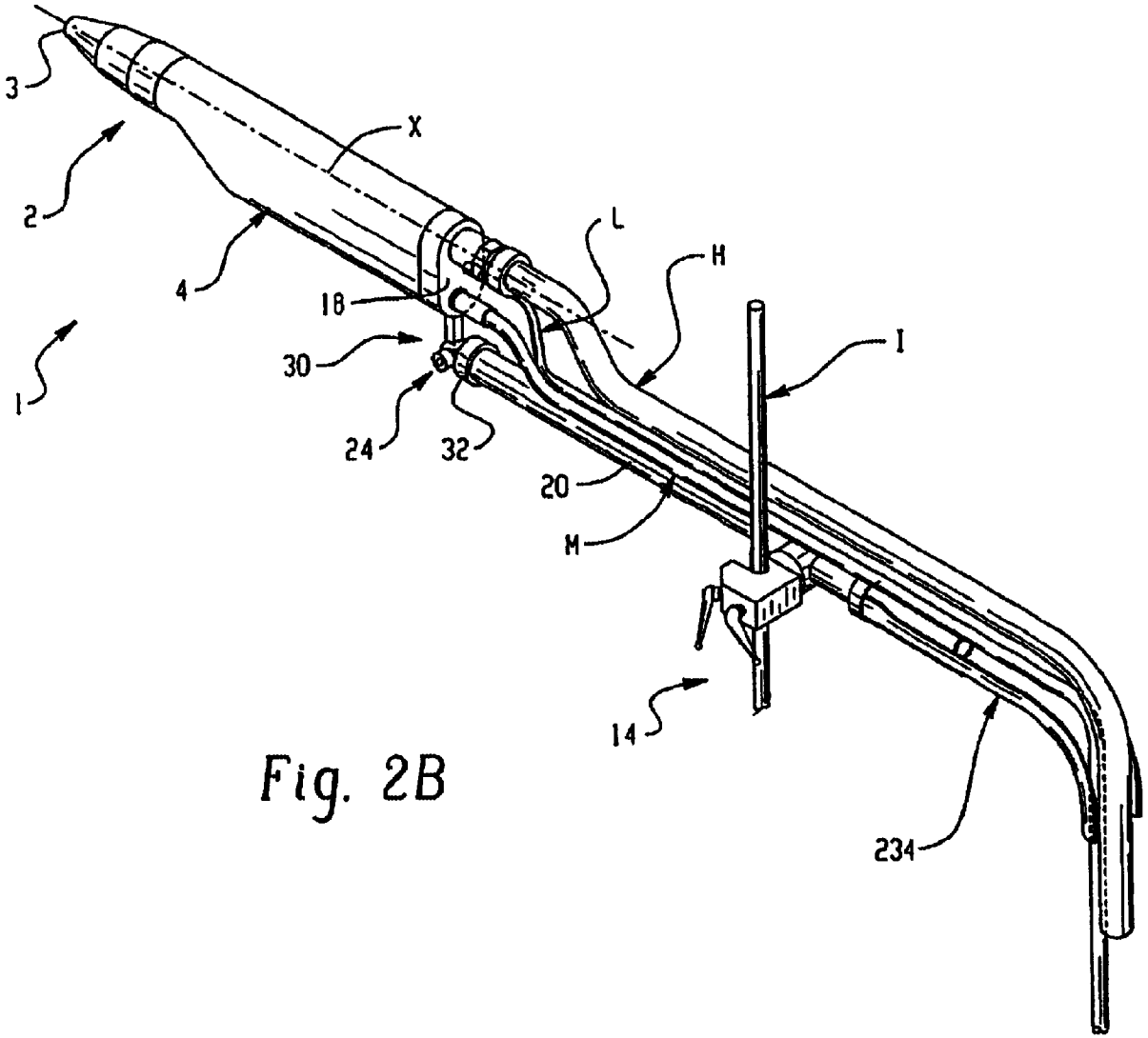
FIG. 2B is a perspective view of a second spray gun configuration referred to herein as a bar mount.

With reference to FIG. 2B, an exemplary embodiment of a bar mount configuration is illustrated in perspective. The basic spray gun 1 design may be the same as for the tube mount configuration of FIG. 2A, thus making the two configurations easily interchangeable with a few component changes, as will be apparent from the subsequent descriptions herein. The bar mount configuration includes the spray gun 1 having the main gun housing 4 and the nozzle assembly 2. The mount tube 5, however, is not used for the bar mount configuration. Rather, the supply lines H, L and M are routed up to the back end of the spray gun assembly 1. These supply lines are then connected via a mounting bracket 18 as will be described in detail hereinafter.

The gun 1 is supported on the main support bar using a conventional clamp assembly as in FIG. 2A. However, in this embodiment, the gun 1 is directly mounted to an adjusting rod 20 that is connected to the bar clamp assembly 14. The adjusting rod 20 is thus axially adjustable relative to the bar clamp assembly 14 when the clamp assembly 14 is loosened. At a second end of the adjusting rod 20 the rod 20 is securely attached or clamped to a ball mount assembly 22. The ball mount assembly 22 allows the gun 1 to be aligned at a selectable orientation relative to the object to be sprayed; and in the preferred embodiment, the ball mount 22 permits a wide range of adjustment angles relative to the horizontal and vertical axes. A bolt 24 can be used with a tool to loosen and tighten the ball mount assembly 22. Optionally a knob could be used in lieu of the bolt 24 to manually adjust the ball mount assembly 30 (see FIG. 4).

Figure 3:
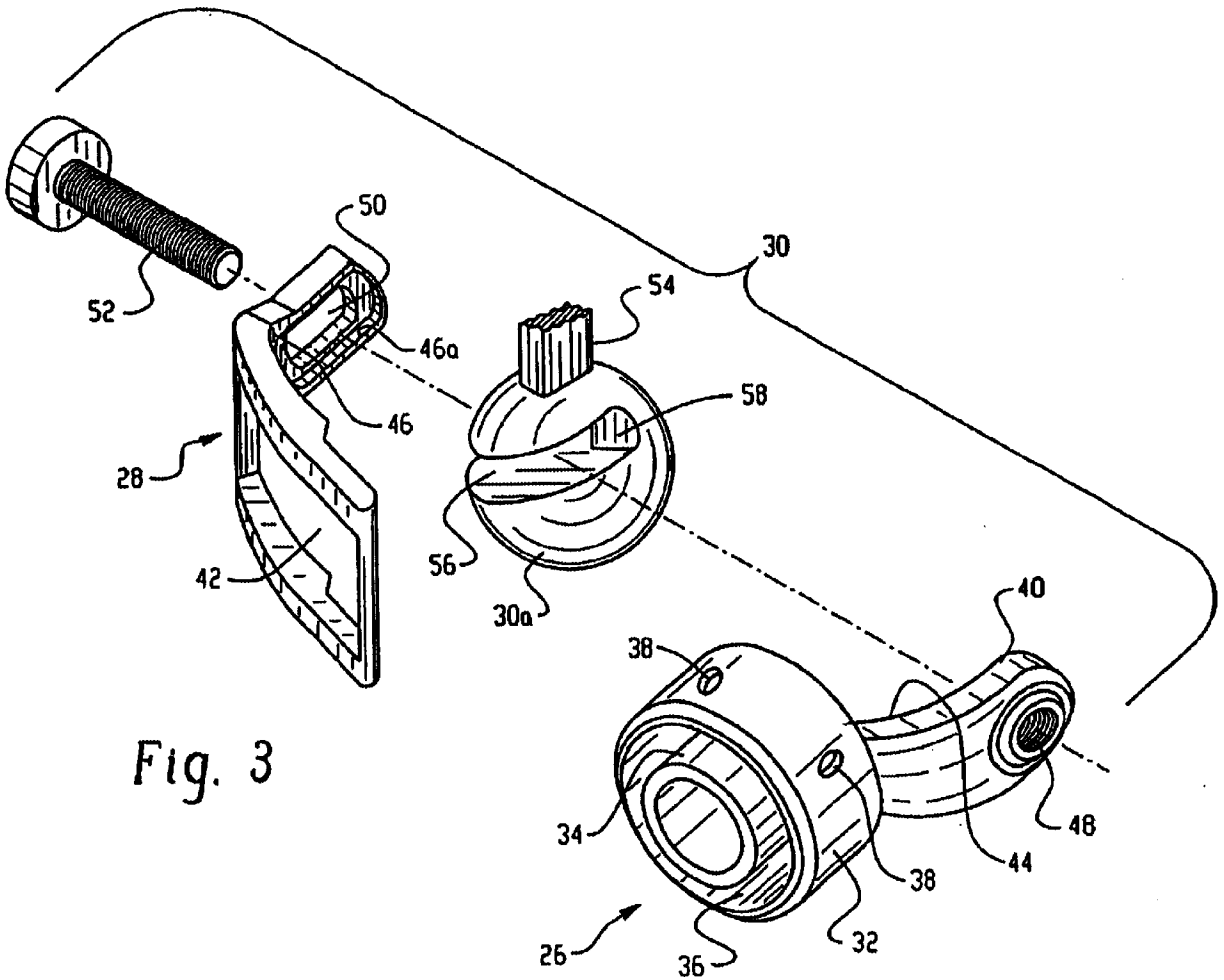
FIG. 3 is an exploded perspective of a ball mount assembly showing the fixed and pivot clamp halves.

With reference to FIG. 3, the ball mount assembly 30 includes a fixed clamp half 26 and a pivot clamp half 28. When assembled, the fixed clamp 26 and the pivot clamp 28 form a releasable clamp that captures and securely holds a ball mount 30 in a selectable alignment. The fixed clamp 26 includes a cylindrical outer shell or sleeve 32 and an integral concentric inner sleeve 34. As best viewed in FIG. 8B, the gun support end of the adjusting bar 20 slips into an annulus 36 that is formed between the inner and outer sleeves 32, 34 of the fixed clamp 26. The dual sleeve arrangement 34, 36 is provided simply to accommodate two different adjusting bar 20 diameters. A smaller diameter bar 20 can slip into the inner sleeve 34 (as shown in phantom in FIG. 8B), while a larger diameter bar 20 can slip into the annulus 36. In either case, tapped through holes 38 are provided through the sleeves 32, 34 to accept set screws (not shown) that affix the fixed clamp half 26 to the end of the adjusting rod 20.

Integrally formed with the fixed clamp sleeve 32 is a fixed clamp arm 40. The fixed clamp arm 40 is arcuate so as to form a first clamping surface 44 (FIG. 4) that conforms generally to the spherical shape of the ball mount 30*a*. The pivot clamp half 28 is similarly arcuate in shape to provide a second clamping surface 46. The pivot clamp 28 includes a central cutout 42. The cutout 42 is appropriately sized to allow the pivot clamp 42 to be slid loosely over the fixed clamp 26 with the first and second clamping surfaces 44, 46 generally facing each other. The clamping surfaces 44, 46 define a cavity or pocket in which the ball mount 30*a* is disposed.

Figure 4:
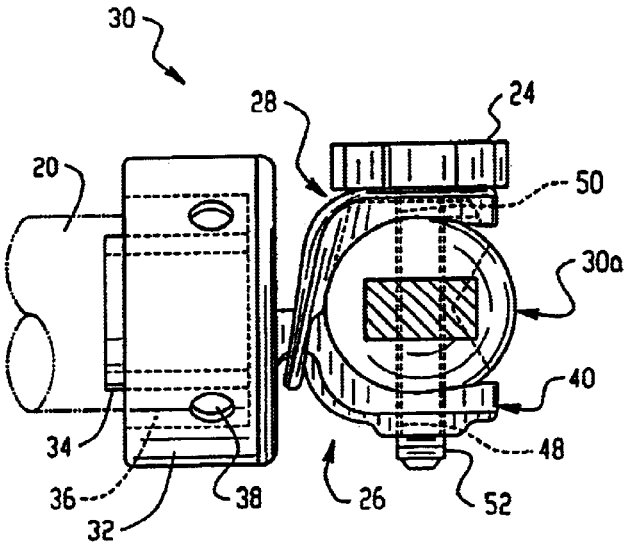
FIG. 4 is a side elevation of the fixed and pivot clamp halves assembled for securely holding a ball mount therebetween.

The fixed clamp arm 40 includes a threaded bolt hole 48, and the pivot clamp 28 includes an unthreaded through hole 50. The adjustment bolt 24 includes a threaded portion 52 on one end that is used to securely hold the clamp halves 26, 28 together with the ball mount 30 clamped therebetween as illustrated in FIG. 4. The adjustment bolt 24 includes an Allen socket to allow for additional tool tightening capability of the clamp members 26, 28. Note that FIG. 4 illustrates an alternative form of the bolt 24 with a knob for manual adjustment rather than an Allen socket bolt head.

Figure 5:
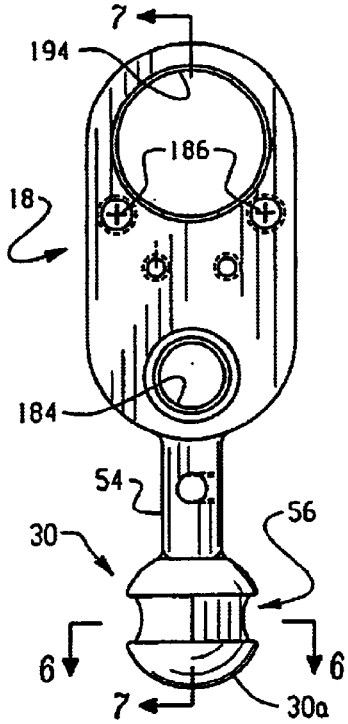
FIG. 5 is a rear end view of a mounting bracket used for a bar mount configuration.

FIG. 5 illustrates an end view of the mounting bracket 18. The ball mount 30 is suspended from the bracket 18 by an integral extension piece 54. The bracket 18 preferably is made of a sturdy lightweight material such as aluminum, for example. As will be explained hereinafter, the bracket 18 main body is inserted into the back end of the gun housing 4 and a slot is provided in the housing 4 to accept the extension 54. The bracket 18 is secured in the gun by any suitable means such as screws (for the bar mount configuration only). Thus, the ball mount 30 can fully support the spray gun 1.

Figure 7:
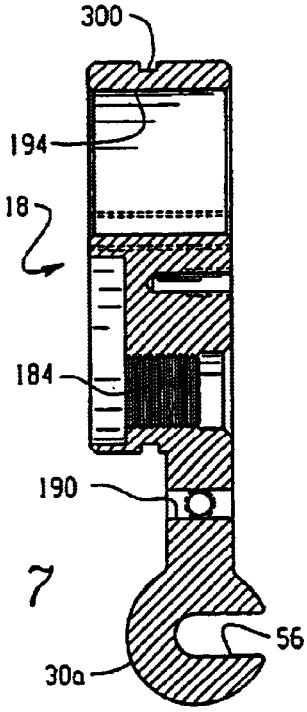
FIG. 7 is a vertical section of the mounting bracket of FIG. 5.

In use, the fixed clamp 26 is first secured to the end of the adjustment bar 20 by tightening the set screws through the sleeve holes 38. The operator then slips the pivot clamp 28 onto the fixed clamp 26 by inserting the free end of the fixed clamp arm 40 through the slot 42. At this time the pivot clamp 28 loosely hangs on the fixed clamp 26. Next, the assembled gun 1 is held so as to position the ball 30*a* between the clamp surfaces 44, 46. The bolt 52 is then inserted through the first hole 50, through a slot 56 (see FIG. 7) through the ball mount 30 and into the threaded hole 48 in the fixed clamp 26. As the bolt 52 is tightened down, the ball 30*a* is clamped between the fixed arm 40 and the pivot clamp 26. The bolt 52 thus also serves as a pivot axis for the ball 30*a*. Prior to full tightening of the bolt 52, the ball 30*a* is free to swivel between the clamping surfaces 44, 46 thus allowing a wide range of angular alignments of the gun 1 along both the vertical and horizontal independent axes. The clamping surfaces 44, 46 are preferably machined or formed with sharp edges 46*a* that bite into the ball 30*a* to securely hold the ball 30*a* in position when the bolt 52 is fully tightened.

Figure 6:
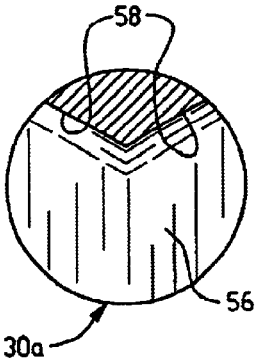
FIG. 6 is a cross-section view of the ball mount taken on the line 6—6 in FIG. 5.

As illustrated in FIGS. 5 and 6, the slot 56 of the ball 30*a* is preferably not a straight slot but rather is V-shaped. This allows the ball 30*a* to be adjusted in the horizontal plane. In the exemplary embodiment herein, the V-shape is formed to allow up to about a 30° lag or lead angle of the gun relative to the longitudinal axis of the adjusting rod 20, thus allowing a lag or lead angle relative to the part being sprayed. The groove walls 58 thus serve as positive stops against the bolt 52 at the maximum angles of lag and lead. Other angles may be selected as appropriate for a particular application. It is also preferred though not required that the ball 30 material be softer than the clamp 28, 40 material to allow the clamp to bite into the ball for a more secure clamping action.

IV. Powder Spray Gun with Bar Mount Configuration

With reference next to FIG. 8, the spray gun 1 will now be described in detail for the bar mount configuration. However, most of the details of the gun 1 components are the same for both the bar mount and tube mount configurations, except for the specific details relating to the mounting structures. Therefore, the gun 1 detailed description will be only provided herein once, it being understood that the basic gun 1 configuration is the same for both mounting configurations, except as otherwise noted herein. It is intended that the same gun 1 design can be conveniently used for both mounting configurations with only the need to substitute a few parts as will be explained, thus significantly increasing the flexibility and configurability of the overall powder spray apparatus.

Figure 8A:
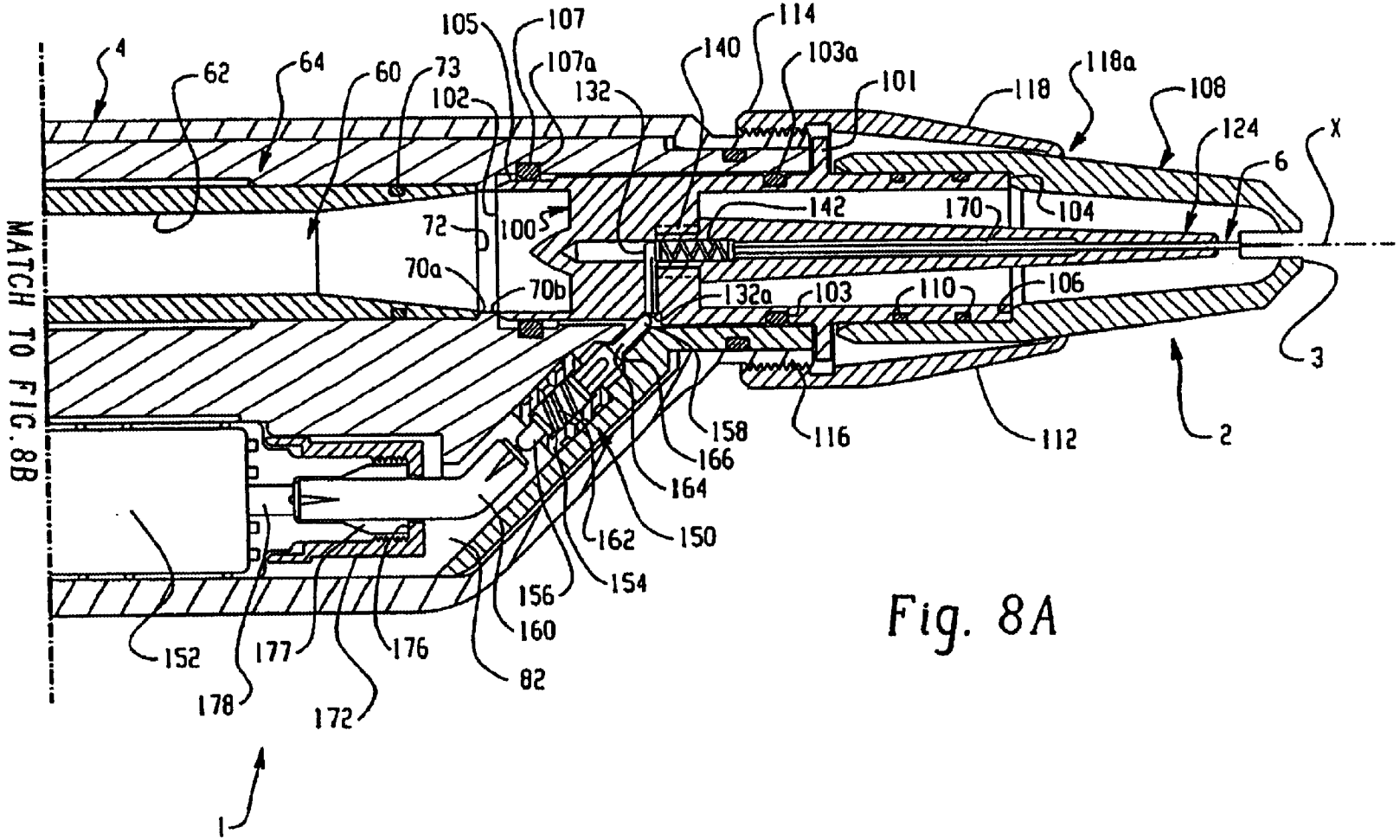
FIGS. 8A and 8B are a detailed illustration of a bar mount electrostatic powder spray gun in accordance with the invention, shown in longitudinal cross-section.
Figure 8B:
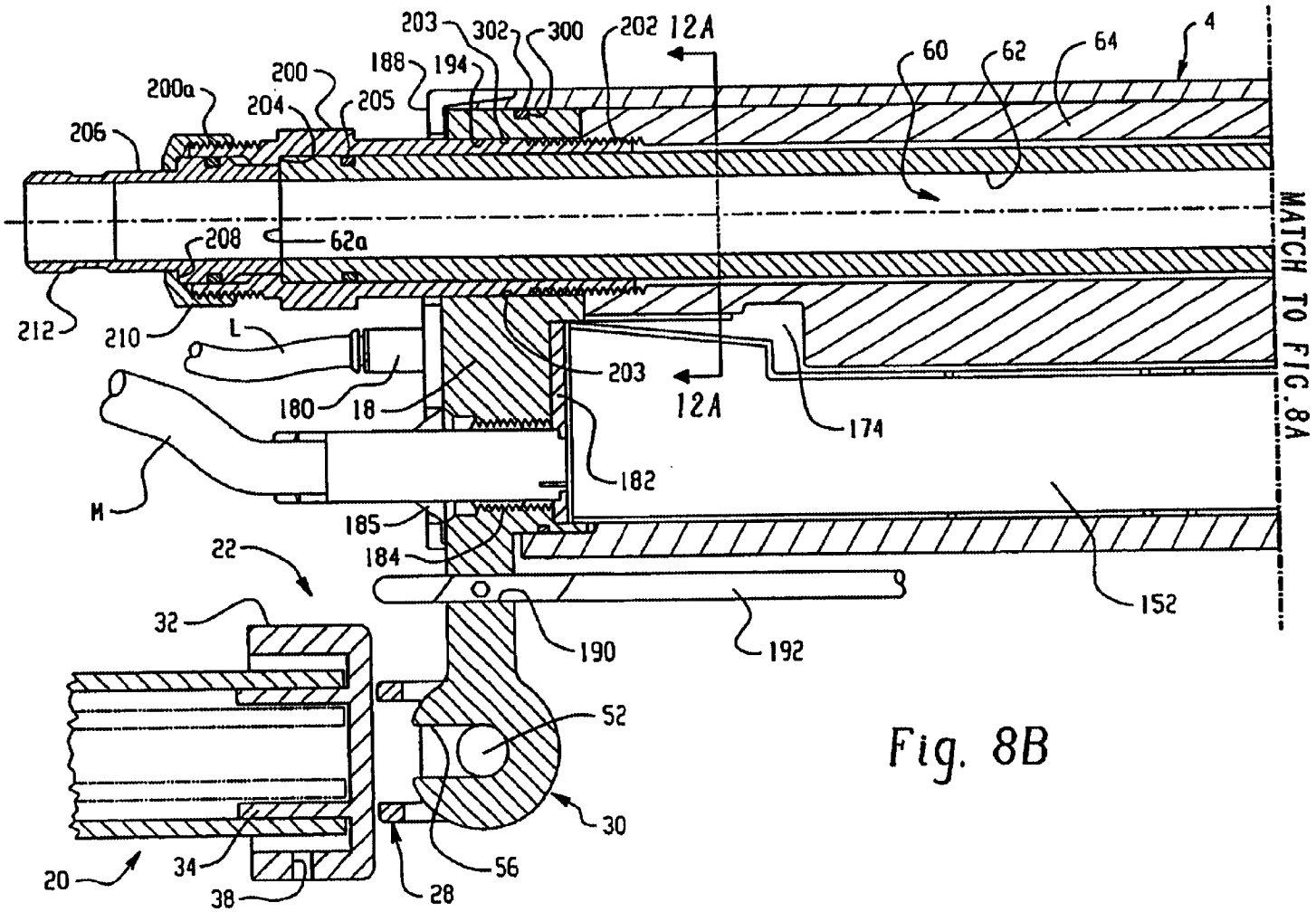

As noted herein before, a significant aspect of the present disclosure is the use of a gap free powder path through the spray gun 1. In the embodiment of FIGS. 8A–B, the powder path 60 is made up of a number of segments which are tightly abutted end to end to eliminate all gaps and recesses or other anomalies that could either trap powder particles or allow powder to escape the powder path and get into the gun 1 interior or be released to the surrounding atmosphere. Thus, in accordance with this aspect of the invention, a tight and closed powder path 60 is provided from the powder inlet to the gun 1 to the powder spray outlet 3 at the forward end of the nozzle assembly 2. The powder path 60 segments are tightly held together in axial compression by the use of externally threaded connectors as will be described herein. Since no internal threads or fasteners are needed to secure the powder path, any opportunity for powder to become trapped is greatly diminished since a continuously smooth powder path 60 is formed from inlet to outlet. Preferably, the powder path 60 extends along a substantially straight line, in this example the longitudinal axis X of the gun. Having the powder path 60 entirely linear along a single axis permits much tighter control of the interface joints between segments of the powder path 60.

The basic segment of the powder spray gun powder path 60 is the powder feed tube 62. The powder feed tube 62 is preferably a fairly rigid cylindrical tube of plastic and has a powder inlet end 62*a* and an outwardly flared outlet end 72. The outlet end 72 includes an o-ring 73 as a backup seal to the interface at the end 72 and the shoulder 70*a*. The powder feed tube 62 is inserted into the main gun housing 4, and in this embodiment is supported in the housing 4 via a housing insert 64.

Figure 9A:
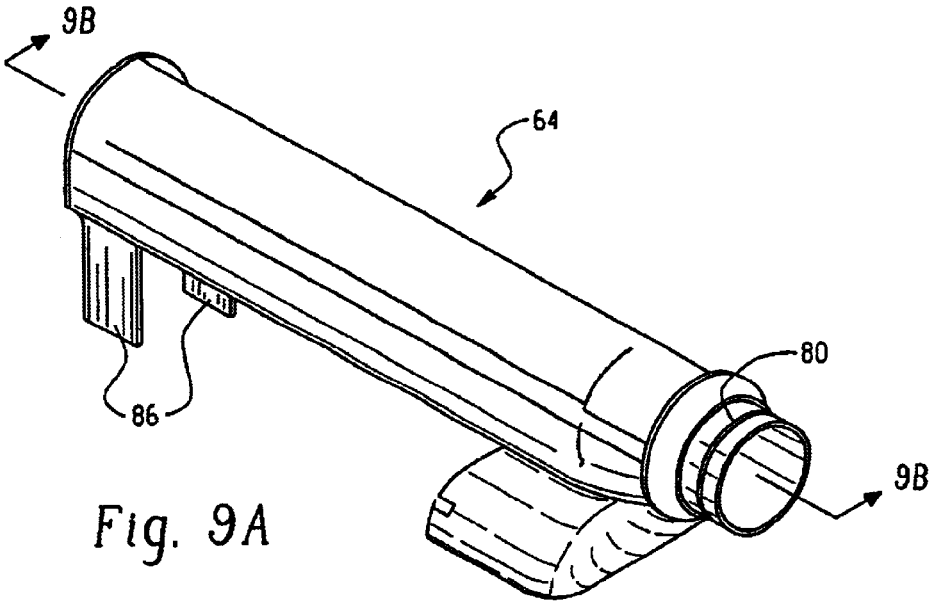
FIGS. 9A and 9B illustrate a spray gun housing insert used with the powder spray gun.
Figure 9B:
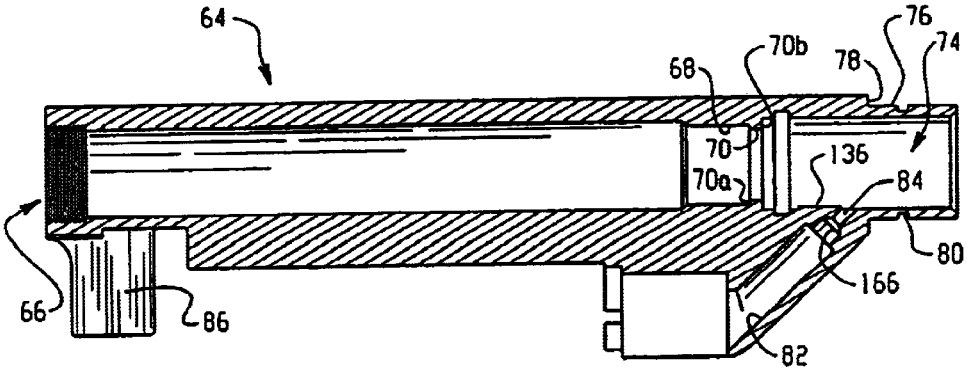

The housing insert 64 is preferably a single piece component made of plastic or other suitable material. FIGS. 9A and 9B illustrate in detail the housing insert 64. The housing insert 64 is a generally cylindrical structure that has an internally threaded back end 66. A central passageway 68 extends through the insert 64 and includes an inwardly extending rib 70 near the forward end thereof. The rib 70 provides a rearward face 70*a* and a forward face 70*b*. The powder feed tube 62 is sized to closely and easily slide into the central passageway 68. As more clearly viewed in FIG. 10, the powder feed tube 62 has a forward end 72 that abuts the rearward face 70*a* of the rib 70 without any significant gap or recess therebetween. With further reference to FIG. 9B, the central passageway 68 includes a forward portion that is of larger diameter than the central portion thereof and forms a spider receiving bore 74. The forward end of the housing insert 64 has a wall 76 with an outer diameter that is slightly less than the outer diameter of the housing insert 64 body to form a shoulder or step 78. A seal groove 80 such as for an o-ring seal 80*a* (FIG. 11) may be provided in the wall 76 as illustrated.

The housing insert 64 further includes a downwardly and rearwardly extending cartridge bore 82. At its forward end, the cartridge bore 82 has a reduced diameter and terminates at an opening 84 (FIG. 9B) that opens to the spider bore 74. The bore 82 is appropriately sized to slideably receive a cartridge assembly 150 as will be described hereinafter.

Figure 11:
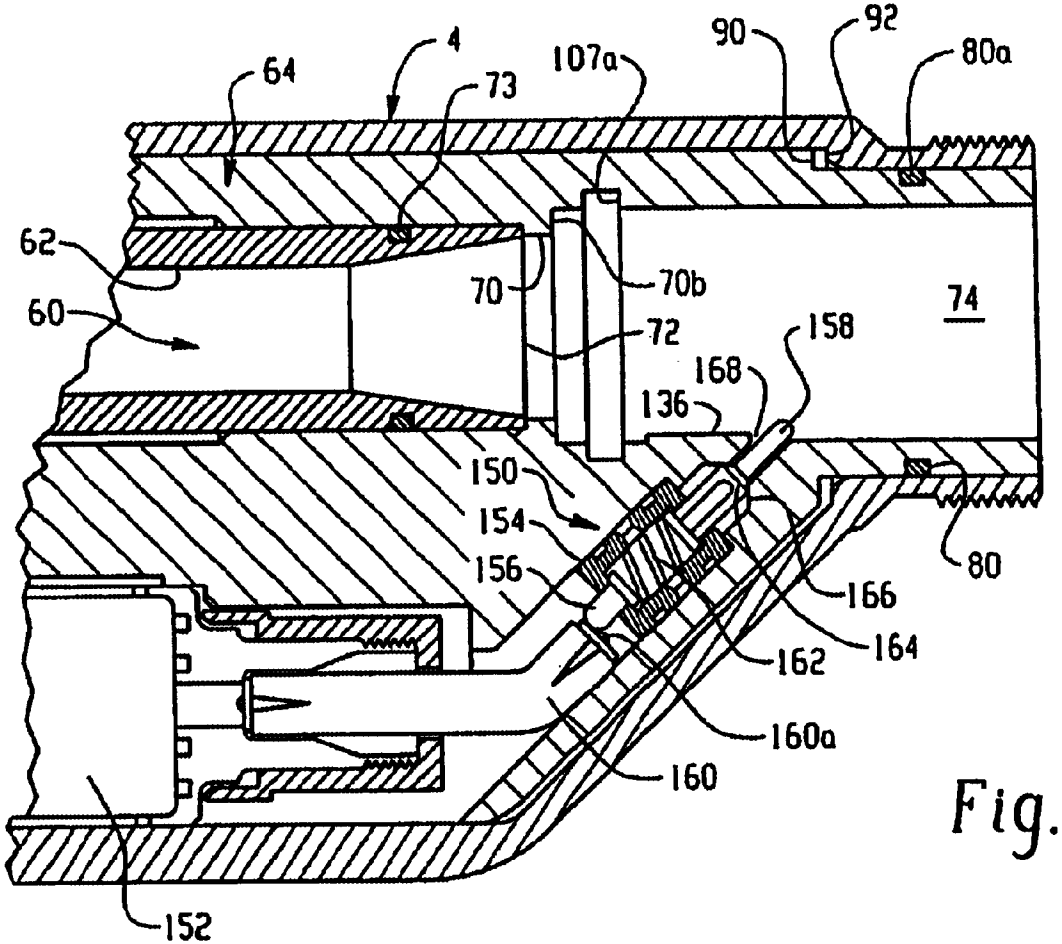
FIG. 11 is an enlarged view of the forward end of the powder spray gun in longitudinal section with the cartridge valve fully closed and the spider removed.
Figure 12A:
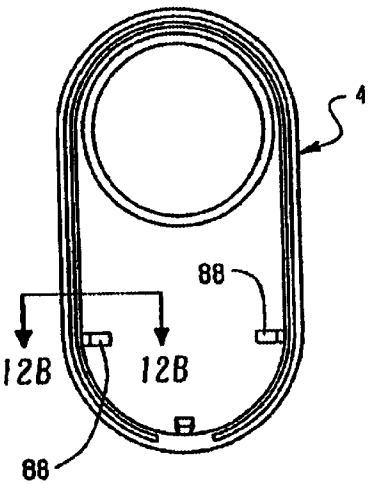
FIG. 12A is a view of the back end of the main gun housing in vertical cross-section.
Figure 12B:
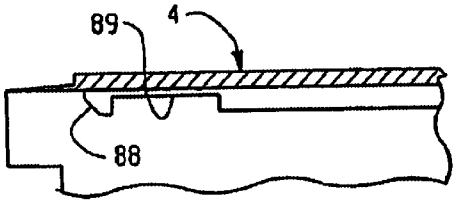
FIG. 12B is a partial cross-section view of the gun housing taken on line 12B—12B of FIG. 12A.

The housing insert 64 further includes near its back end two downward extending retaining tabs 86. With reference to FIGS. 12A and 12B (wherein FIG. 12A is only illustrating features of the main gun housing 4, not the interior components), the main gun housing 4 includes inwardly extending retaining ribs 88 that latch and hold the retaining tabs 86 of the housing insert 64 when the insert 64 is fully inserted into the main gun housing 4. In this manner, the housing insert 64 is securely held in the main housing 4 without the use of any threaded fasteners, and can easily be removed by simply bending the tabs 86 slightly inwardly away from the ribs 88 and then sliding the insert 64 out of the back end of the main housing 4. FIG. 8A illustrates the assembly with the housing insert 64 fully inserted into the main gun housing 4. With reference to FIG. 11, the housing insert 64 includes a forward shoulder 90 that is axially spaced from an inwardly extending shoulder 92 near the forward end of the main gun housing 4. This provides a gap so that the housing insert 64 can be pushed into the main housing 4 to engage the retaining ribs 88 with the retaining tabs 86. The retaining tabs 86 also can be heard to click into place into the slots 89, which are part of the ribs 88, when the housing insert 64 is properly seated.

Figure 8C:
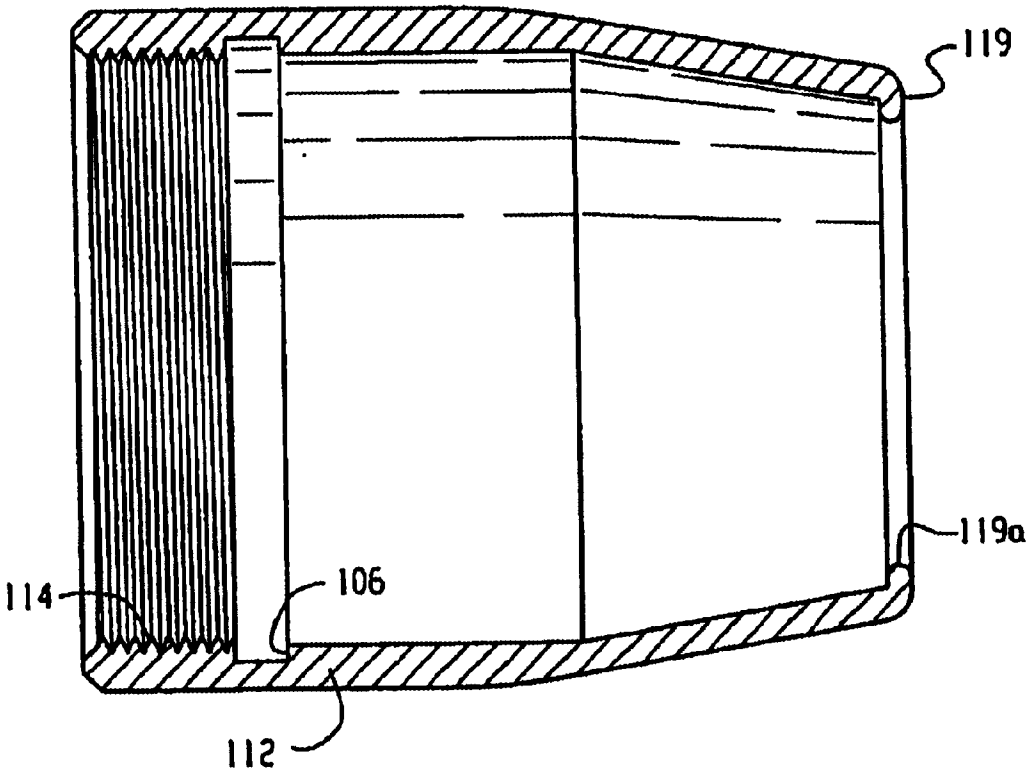
FIG. 8C is a detailed view in longitudinal cross-section of a nozzle lock nut.
Figure 13B:
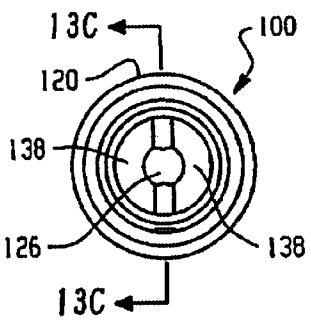
FIGS. 13A–D illustrate a first embodiment of a spider insert.
Figure 13A:
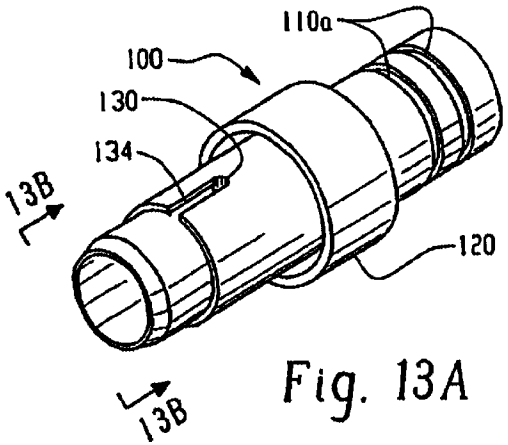
Figure 13C:
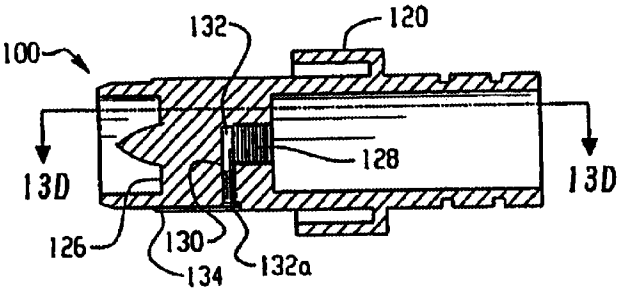
Figure 13D:
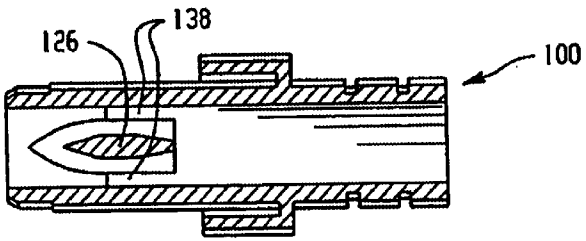

With reference to FIG. 8A, a spider insert 100 is pushed into the spider bore 74 and has a rear wall 102 that bottoms against the forward face 70*b* of the housing insert rib 70. As will be further explained, the forward end 72 of the powder feed tube 62, the inner cylindrical surface of the rib 70 and the rear wall of the spider 100 are held together in tight axial compression to form a continuous gap free path for powder traveling through the powder feed tube 62 to the nozzle assembly 2. The spider 100 extends forward into the nozzle assembly 2 and has a forward wall 104 that abuts a shoulder 106 in a nozzle tip 108. O-ring grooves 110*a* (FIGS. 13A and E) may be provided in the forward portion of the spider 100 to retain o-rings 110 to provide a seal against powder loss to atmosphere. A nozzle lock nut 112 is internally threaded at its back end 114 and is tightened onto a forward threaded end 116 of the main gun housing 4. The nozzle lock nut 112 has a tapering front section 118 that grips a forward tapered end of the nozzle tip 108 as at 118*a*. As best shown in FIG. 8C, the nozzle lock nut 112 has an inwardly formed lip 119. The lip 119 is formed with a radius bead 119*a* or other smoothly curved profile that forms a seal with the nozzle 108 against powder spray outside the gun nozzle as the lock nut 112 is screwed onto the housing 4. As the lock nut 118 is tightened down onto the main housing 4, it pulls the nozzle tip 108 rearward. The nozzle tip 108 and the spider 100 are thus drawn rearward as the lock nut 118 is tightened which forms a tight compression interface between the spider rear wall 102 and the rib 70, and the spider front wall 104 and the shoulder 106. Therefore, there is a continuous gap free straight line powder path 60 through the gun 1 from the back end of the gun through the nozzle tip 108.

Figure 8D:
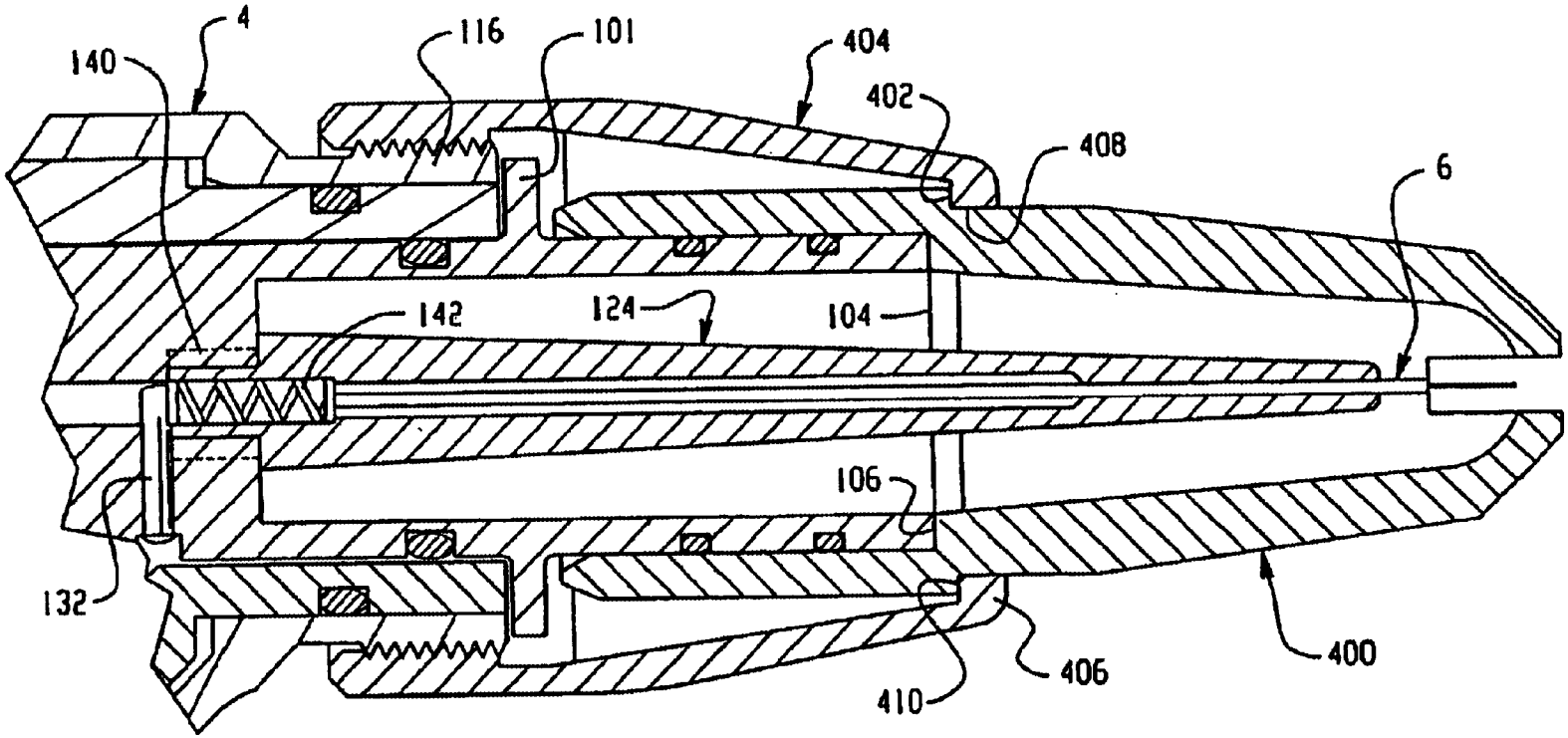
FIG. 8D is a detailed view of a gun nozzle section with an alternative nozzle and nozzle lock nut design.

With reference to FIG. 8D, an alternative design for the nozzle and nozzle lock nut is illustrated. In the configuration of FIG. 8A, there will tend to be a radial expansion of the lip 119 as the lock nut 112 pulls back on the nozzle tip 108. In some applications, particularly depending on the choice of materials for the lock nut 112, the lock nut 112 may not pull the nozzle tip 108 back tight enough to produce a tight interface between the spider forward wall 104 and the nozzle tip shoulder 106, or the seal at the point 118*a* may lose some effectiveness. In the embodiment of FIG. 8D, a modified nozzle tip 400 includes an outwardly extending shoulder 402. The nozzle tip 400 includes the same inward shoulder 104 that engages the spider end wall 104 when the nozzle tip 400 is installed. The nozzle lock nut 404 is formed with an inwardly formed lip 406 that is generally flat at 408 to form a radial shoulder 410. The lock nut shoulder 410 engages the nozzle shoulder 402 to draw the nozzle tip 400 rearward as the lock nut 404 is installed on the threaded end 116 of the gun housing 4. This arrangement assures that the nozzle tip 400 will be tightly pulled back Referring again to FIG. 8A, the spider 100 includes an outwardly extending flange 101. The spider 100 further includes an o-ring groove 103 and an o-ring seal 103*a* disposed therein and axially spaced from the flange 101. The flange 101 can be used for configurations in which the nozzle tip 108 is cylindrical rather than tapered. In such cases, the nut 118 cannot draw back the nozzle tip 108, and instead is designed with a shoulder that pushes on spider flange 101 to draw the spider 100 into the housing insert 64. A gasket (not shown) may be provided behind the flange 101 if so required.

The spider 100 includes a reduced diameter portion 105 adjacent the rear wall 102. This portion of the spider 100 seals against an o-ring seal 107 in a groove 107*a* in the housing insert 64.

Figure 10:
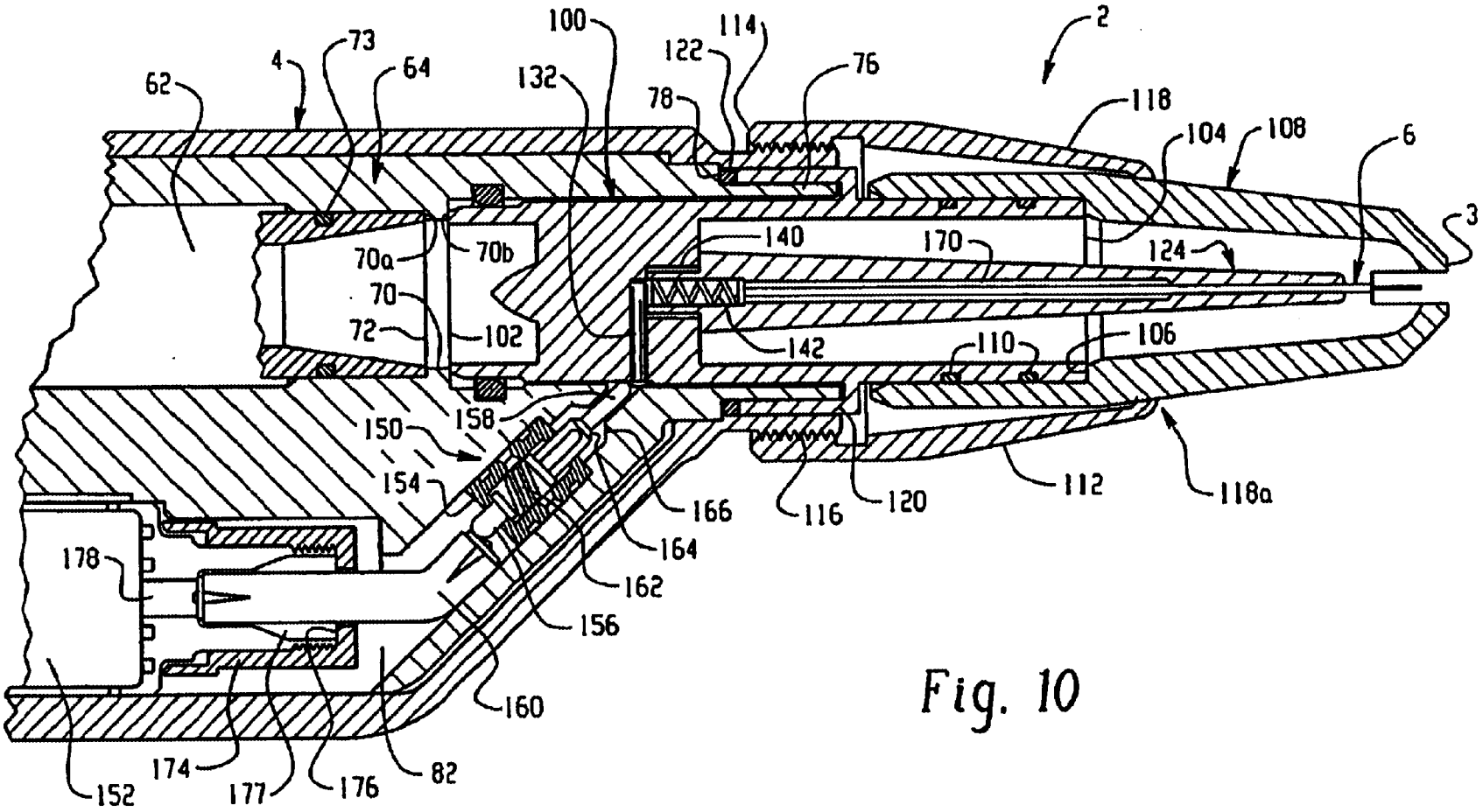
FIG. 10 is a view similar to FIG. 8A but illustrating an alternative embodiment of the spider and housing insert.

In an alternative embodiment illustrated in FIG. 10, the spider 100 has a rearward extending annular wing 120 that slips over the reduced diameter forward end 76 of the housing insert 64. In the embodiment of FIG. 10, an o-ring 122 is disposed between the rear end of the wing 120 and the shoulder 78 on the housing insert 64. Other than these variations of the spider 100 and the housing insert 64, the embodiment of FIG. 10 is substantially the same as for FIG. 8A, and therefore the same reference numerals are used.

Figure 13E:
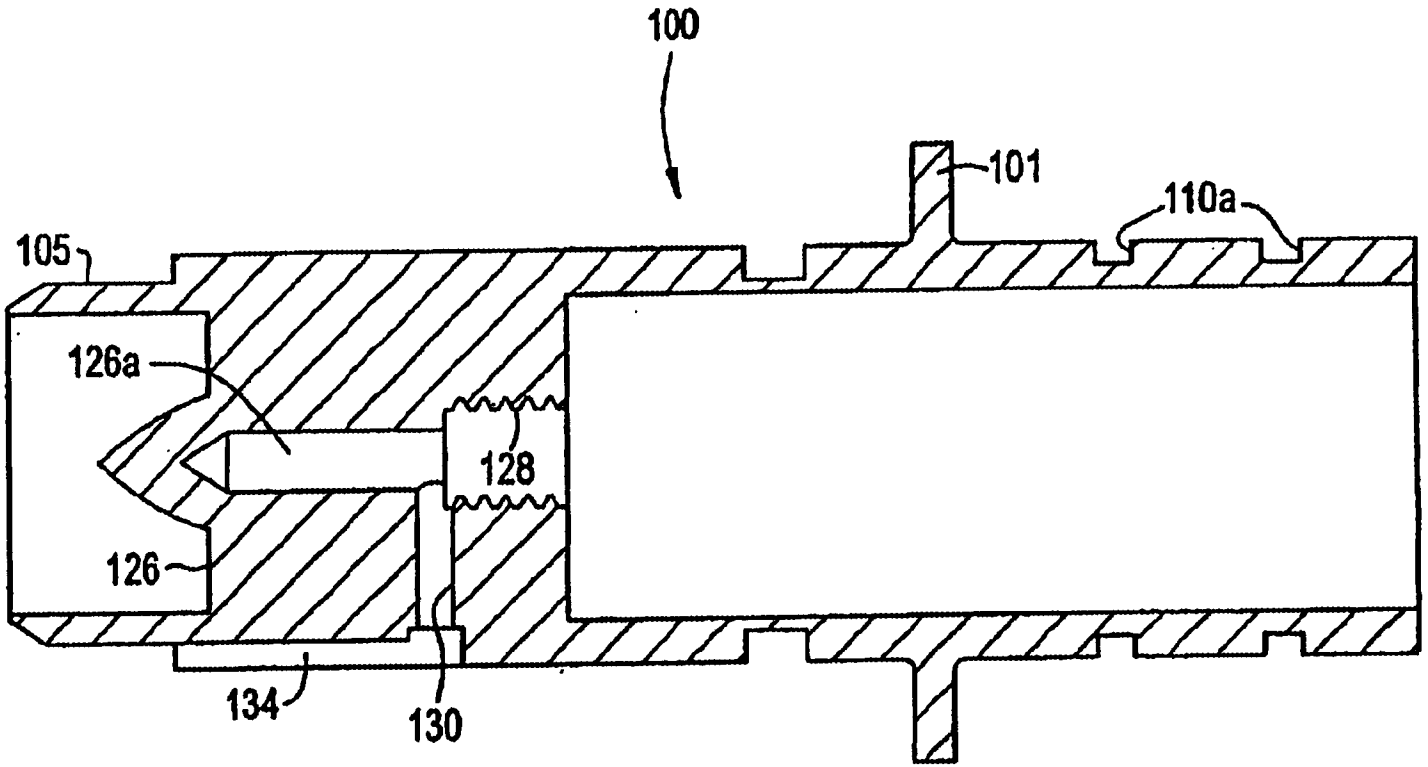
FIG. 13E illustrates and alternative and preferred embodiment of the spider insert in longitudinal cross-section.

The spider 100 is illustrated in detail in FIGS. 13A–E. FIGS. 13A–D illustrate the embodiment of the spider 100 used in FIG. 10, whereas, the embodiment of the spider used in FIG. 8A is illustrated in FIG. 13E. The two configurations are substantially the same except for the wing 120 as noted hereinabove and therefore will only be described once herein.

With reference to FIGS. 13A–D, the spider 100 is a generally cylindrical structure that is used to hold and align the high voltage electrode 6 via an electrode holder 124 (FIGS. 8A and 10). The spider 100 includes a diametrically positioned powder diverter 126. The diverter 126 extends axially through a portion of the spider 100 interior. The diverter 126 is tapered rearwardly (see FIG. 13D) and at its forward end includes a threaded axially centered bore 128. A transverse hole 130 opens at an inner end to the rear portion of the threaded bore 128 and at an outer end through the side wall of the spider 100 body. The diverter 126 may be cored out as at 126*a* as part of the manufacturing process. A contact tube or hollow pin 132 is inserted into the hole 130 and extends from the spider 100 outer wall to the back end of the threaded bore 128. The pin 132 preferably includes an enlarged pin head 132*a* to prevent the pin 132 from being pushed too far into the hole 130, and also to provide a larger electrical contact area as will be apparent herein after. The hollow tube or pin 132 allows for the flow of air for purposes that will be described shortly. Alternatively, the hole 130, for example, can be a plated through hole. In any case, an electrically conductive path is provided from the back end of the bore 128 through to the outer wall of the spider 100 body.

An axially extending slot or keyway 134 extends rearward from the pin 132 near to the rear end of the spider 100. This slot 134 slideably receives an axially extending rib or key 136 formed in the "six o'clock" position of the housing insert 64 (see FIG. 9B). The slot 134 and key 136 cooperate to insure that the spider 100 is properly aligned when the spider 100 is axially inserted into the spider bore 74 at the forward end of the housing insert 64. The use of the keyway being formed in the spider 100 allows for a keyed alignment of the spider 100 in the housing insert 64 without the need for an axially long keyway. For example, if the keyway were formed in the housing insert 64 with the key being formed on the spider, the keyway would likely have to be fairly long in axial length along the housing to permit easier assembly. Having such an extended slot in the housing would provide an undesirable conduit for electrical discharges towards the front of the gun. A slot in the housing also would necessitate a thicker housing wall to maintain structural integrity of the housing while accommodating the slot. The present invention thus avoids such situations.

Powder entering the spider 100 rear end from the powder feed tube 62 is diverted around the diverter 126 on either side thereof through two flow channels 138. The powder stream re-merges into a single flow stream through and out the forward portion of the spider 100 body and into the nozzle tip 108.

The electrode holder 124 has a threaded boss 140 at the back end thereof (FIG. 8A). The electrode holder 124 is screwed into the threaded bore 128 of the spider 100, thus centering and aligning the electrode holder 124 in the powder flow stream that flows through the spider 100 and the nozzle assembly 2. The electrode holder 124 is preferably an axially tapered structure with the wire electrode 6 disposed axially therein. The electrode 6 has a spring 142 connected to the rear end thereof and this spring 142 makes electrical continuity with the inner end of the conductive tube 132 in the spider 100 when the electrode holder 124 is fully seated in the bore 128.

With reference to FIGS. 8A, 10 and 11, a valve and electrode contact cartridge assembly 150 provides an electrical connection from the voltage multiplier 152 to the electrode 6 via the conductive pin 132. The cartridge 150 includes a cartridge housing 154 that slideably retains two longitudinally displaceable spring loaded contacts. These contacts are a multiplier contact 156 and a spider electrode contact 158. The housing 154 in this example is a two piece generally cylindrical device that is assembled outside the gun. Both contacts 156, 158 include shoulders that retain portions of the contacts inside the housing 154. An electrically conductive spring 162 provides electrical continuity between the contacts 156, 158 and biases the contacts away from each other within the housing 154. The multiplier contact 156 electrically contacts a multiplier output wire 160 when the multiplier 152 is fully inserted and seated in the main gun housing 4. The output wire 160 in this embodiment is a fairly rigid piece of high voltage electrostatic cable core with a contact 160*a* at the end thereof. The wire 160 bends at an appropriate angle to pass into the angled cartridge bore 82 of the housing insert 64 as the multiplier 152 is inserted into the gun housing 4.

The spider electrode contact 158 extends from within the cartridge housing 154 and includes a valve stem 164. The stem 164 extends outside the cartridge housing 154 and is appropriately sized to seat and seal against a valve seat 166 formed in the cartridge bore 82 of the housing insert 64. The spring 162 urges the stem 164 to the closed position as illustrated in FIG. 11. The valve stem 164 is able to close under the force of the spring 162 when the spider 100 is not fully seated in the spider bore 74. As shown in FIG. 11, when the spider 100 is removed from the bore 74, or at least out of contact with the spider contact pin 158, the spring 162 pushes the contact 158 with the valve stem 164 forward to close the valve. In this position, the contact 158 extends through a small angled hole 168 in the housing insert 64. When the spider 100 is inserted into the bore 74, it pushes the contact 158 back against the force of the spring 162. When the spider 100 is fully inserted and seated in the bore 74 by tightening down the nozzle lock nut 118, the electrode contact pin 132 and in particular the pin head 132*a* makes electrical contact with the spring biased contact 158. In this manner, there is excellent electrical continuity from the multiplier output wire 160 to the electrode 6 via the multiplier contact 156, the spring 162, the spider contact 158, the contact pin 132 and the electrode spring 142.

Several features of this construction are important to note. The straight in-line powder path 60 defined by the powder feed tube 62, the spider 100 and the nozzle assembly 2 is centrally disposed along the longitudinal axis of the spray gun 1, permitting a gap free fully enclosed powder path. The electrode 6 is also disposed ideally along the gun longitudinal axis coaxial with the center of the powder flow. The angled cartridge 150 permits the multiplier 152 to be positioned in the gun housing 4. below or above the powder path 60, with the multiplier 152 and the spider 100 being individually removable from the gun housing 4. The spider 100 can be removed as needed for cleaning, and the electrode holder 124 can be removed without removing the spider 100. When the spider is removed, the valve stem 164 seats against the valve seat 166 to close the valve. This prevents powder from passing down through the bore 82 to the multiplier 152. Thus, during routine maintenance or color changeover, air can be used to blow powder residue out of the front end of the gun housing 4 without powder being blown into the housing interior, while at the same time allowing easy access to the multiplier and electrode for repair and replacement as needed. The rib and slot arrangement 136, 134 insures that the spider 100 is properly oriented when it is inserted into the housing 4 so that there is positive contact between the spider pin 132 and the spider contact 158.

The cartridge assembly 150 is designed so that when the multiplier 152 and the spider 100 are fully inserted and seated in the gun 1, an air flow path is available from the region of the multiplier 152 through the cartridge 150, around the contact 158, through the hole 168, through the tube 132 and into the electrode holder 124. This can be easily accomplished, for example, by providing an air flow path through the cartridge housing 154. In the illustrated embodiment, air flows through the contacts 156, 158 and around the spring 152 and out past the stem 164 when the stem is in the open position. The electrode holder 124 includes an air channel 170 along its length. This air path allows for air wash electrode operation to provide positive air pressure at the electrode tip to prevent powder from accumulating on the electrode and from traveling back into the gun 1 via the electrode holder 124. When the valve 164 is closed the air path is interrupted at the cartridge 150, specifically at the seal formed between the stem 164 and the seat 166.

With reference to FIGS. 8A and 8B, the multiplier 152 is inserted into the main gun housing 4 from the back end of the housing. The multiplier 152 includes a multiplier output lock nut 172 that securely holds the multiplier output wire 160 to an output pin on the multiplier 152. More specifically, the nut 172 includes an inward shoulder 176 that engages a ferrule 177 at a rear end of the conductor 160. The ferrule 177 tightly grips the conductor 160. The nut 172 is threaded onto or otherwise attached to the multiplier 152 housing. As the nut 172 is tightened down, the ferrule 177 is pulled toward the multiplier 152 and urges the conductor 160 into making good electrical contact with an output pin 178 on the multiplier 152. Preferably, the multiplier 152, nut 172, ferrule 177 and cable 160 are fully assembled as a complete unit before the multiplier 152 is inserted into the main housing 4. The multiplier 152 sits on a nib on the bottom wall of the main gun housing 4 in a cavity 174 defined by the housing 4 and the housing insert 64. An air inlet fitting 180 is provided to which a suitable air line L can be connected. The fitting 180 is in fluid communication with an air passage (not shown) that feeds air from the air line L into the multiplier cavity 174 for cooling the multiplier 152. The air passing into the cavity 174 also is used for the electrode air wash as described hereinbefore.

After the multiplier 152 is installed in the main gun housing 4, the mounting bracket 18 (FIG. 7) is inserted in the back end of the gun housing 4. A resilient gasket 182 is positioned between the mounting bracket 18 and the multiplier 152 in order to secure the multiplier axially within the housing 4 to minimize vibration. The bracket 18 includes a threaded bore 184 through which a power cable M connector can be inserted into the housing 4 and connected to the input to the multiplier 152. A lock nut 185 on the cable M threads into the bore 184 to securely hold the cable M in electrical contact with the input pins of the multiplier 152. Screws 186 (FIG. 5) can be used to securely attach the mounting bracket 18 to the back end of the housing insert 64 (the mounting bracket in the tube mount configuration is indicated by the numeral 19 in FIG. 14A and is not attached to the housing insert 64 with screws or otherwise as is further explained herein). An end cap 188 may be used to cover the main gun housing 4. Note that the mounting bracket 18 may include a bore 190 in the extension 54. An ion collector rod is securely mounted in this bore 190. The mounting bracket 18 also includes a powder feed tube bore 194. The bracket 18 (and also the bracket 19 for the tube mount configuration shown in FIG. 14A) is also provided with a seal groove 300 that retains an o-ring seal 302 to seal the bracket against the housing 4. This functions to seal against air pressure inside the housing 4.

With continued reference to FIGS. 8A and 8B, the powder feed tube 62 is slipped into the main gun housing 4 through the bracket 18 until the forward end of the feed tube 72 abuts the rear face 70*a* of the housing insert rib 70 (FIG. 9B). A tubular feed tube lock nut 200 is used to securely hold the powder feed tube 62 within the gun housing 4 and tightly abutted against the housing insert rib 70 to minimize gaps therebetween. The lock nut 200 has an externally threaded forward end 202. This forward end 202 is threadably inserted into the threaded bore 66 at the back end of the housing insert 64 (FIG. 9B). An o-ring 203 is provided to seal the lock nut 200 against the bracket 18 to seal air in the gun housing 4. Near its back end, the powder tube lock nut 200 has an inward shoulder 204 that pulls the powder tube 62 axially forward tightly against the rib 70 of the housing insert as the lock nut 200 is threaded into the back end of the housing insert 64. In this manner, the powder feed tube 62 is tightly and axially compressed at its forward end against the rib 70 to form part of the smooth continuous straight gap free powder path 60 as previously described herein. It is important to note that the entire powder path is gap free and the various segments are held together in compression using externally threaded connectors with no fasteners. An o-ring 205 seals the powder tube back end against the lock nut 200.

A powder feed hose connector 206 is used to connect a powder feed hose H to the back end of the spray gun 1. The connector 206 slides into the back end of the lock nut 200 and abuts the back end 62*a* of the powder feed tube. The coupling 206 includes an outwardly extending shoulder 208. The back end 200*a* of the nut 200 is externally threaded and a lock nut 210 is threaded onto the back end of the nut 200. The lock nut 210 has an inward flange that engages the shoulder 208 of the connector 206. As the nut 210 is tightened down it draws the coupling 206 axially forward to form a gap free interface at the back end 62*a* of the powder feed tube. Thus, an entirely enclosed gap free powder path is provided from the powder inlet feed line H to the nozzle 2 and is held in axial compression by a number of externally threaded connectors. In the example of FIG. 8, the powder path is formed by the segments that include the powder hose connector 206, the powder feed tube 62, the spider 100 and the nozzle tip 108. The connector 206 includes a rearward extending nipple portion 212 onto which the powder feed hose H can be pushed or otherwise connected. Note that the lock nut 200 extends into the main gun housing 4 through the mounting bracket bore 194.

V. Powder Spray Gun with Tube Mount Configuration

With reference to FIG. 14, for the tube mount configuration the basic design of the spray gun 1 is the same as for the bar mount configuration. The most notable difference is that the mounting bracket 19 for the tube mount configuration does not include the downward extension 54 and the ball mount 30. Furthermore, the bracket 19 is not fastened or otherwise secured to the gun 1, but rather is simply slip fit into the back end of the gun housing 4.

As previously described, in the tube mount configuration there is provided an elongated mount tube 5 that may, for example, be made of two integral sections 5A and 5B that are permanently joined together. The forward end of the mount tube 5*c* telescopically fits over a reduced diameter boss end at the back of the main gun housing 4. No fasteners or other means are used to secure the mount tube 5 to the back end of the gun housing 4. An inwardly extending shoulder 214 abuts the back wall of the mounting bracket 19 to position the bracket 19 axially when the gun 1 is fully assembled.

In the tube mount configuration the powder feed tube 62 extends all the way from the spider 100 and nozzle assembly 2 past the back end of the mount tube 5. Concentrically disposed about the outside of the feed tube 62 is a tie bar 216. The tie bar 216 is a generally tubular structure and is externally threaded at its forward end 216*a* and its rearward end 216*b*. The forward threaded end of the tie bar 216*a* threadably mates with the internally threaded bore 66 at the back end of the housing insert 64 and is provided with an o-ring seal to seal air in the gun housing 4. It should be noted that although in the preferred embodiment the tie bar 216 is secured at its front end to the rear portion of the housing insert, this is for convenience only. The tie bar could extend further into the main gun housing 4 and be threadably mounted to a different portion of the housing insert. Still further, the powder feed tube itself could serve a dual purpose as the tie bar by being provided with a threaded forward end, as will be readily apparent to those skilled in the art. The shorter tie bar 216 seated at the rear end of the housing insert 64 is preferred since this is a blind assembly step and therefore is easier to carry out with a shorter tie bar.

A tube inlet bracket 218 is used to provide a rigid frame for securing the tie bar 216. FIGS. 15A and 15B illustrate an exemplary embodiment of the tube inlet bracket 218. The bracket 218 includes a threaded rear bore 220 and a non-threaded front bore 222. The bores 220, 222 are axially separated yet joined by a common bracket body 224. This arrangement provides a generally central open slot 226 for purposes that will be described shortly. A bracing rib 228 is provided about the outer perimeter of the bracket body that forms the non-threaded bore 222. As illustrated in FIG. 14, the tie bar 216 extends rearward to a point such that when the tie bar 216 is fully seated into the threaded back end 66 of the housing insert 64, the threaded rear end 216b of the tie bar 216 partially extends axially into the region of the bracket slot 226. The tie bar back end 216*b*, however, does not extend all the way past the slot 226 to the threaded bore 220, but rather there remains an axial gap that is sufficient to permit a threaded tension nut 230 to be threaded onto the back end of the tie bar 216. A rear wall 232 of the non-threaded bore 222 engages with the forward face of the tension nut 230 (see FIG. 14). As the tension nut 230 is threaded onto the back end of the tie bar 216, the nut 230 pushes the bracket 218 forward. The bracing rib 228 abuts the rear wall of the mount tube 5. As the tension nut 230 is further tightened onto the tie bar 216, the bracket 218 is pushed further forward causing the mount tube 5 to be pushed against and held rigidly in compression with the main gun housing 4. Preferably the tie bar 216 is made of a very rigid plastic such as PVC thus providing a very strong and rigid structure that securely holds the gun 1 together.

A hose connector 206 is assembled and joined to the back end of the powder feed tube 62 using a tube lock nut 200 in a manner substantially the same as the embodiment of FIG. 8. In the embodiment of FIG. 14, however, the lock nut 200 forward end is threadably joined to the threaded bore 220 of the tube inlet bracket 218, rather than to the housing insert 64 as done on the embodiment of FIG. 8. A lock nut 210 pulls the connector 200 into compressive engagement with the back end of the powder feed tube 62*a*.

Figure 14A:
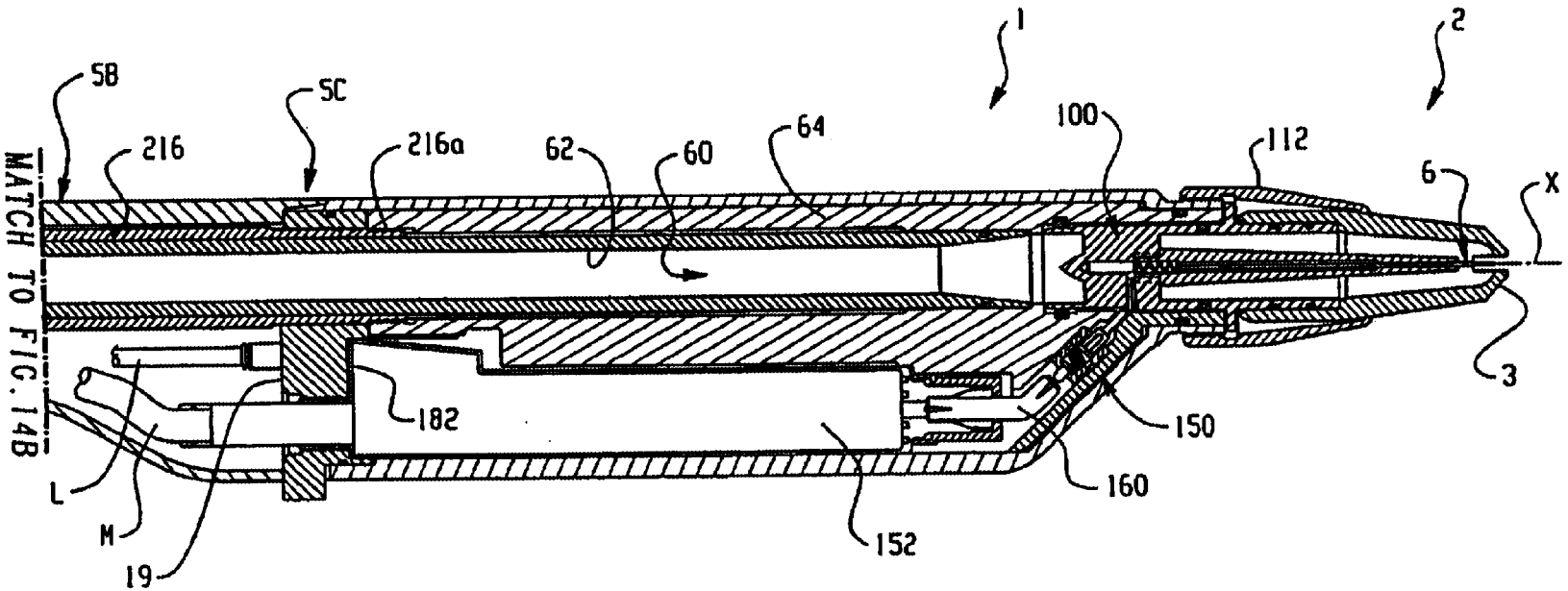
FIGS. 14A and 14B is a spray gun using a tube mount configuration, in longitudinal cross-section.
Figure 14B:
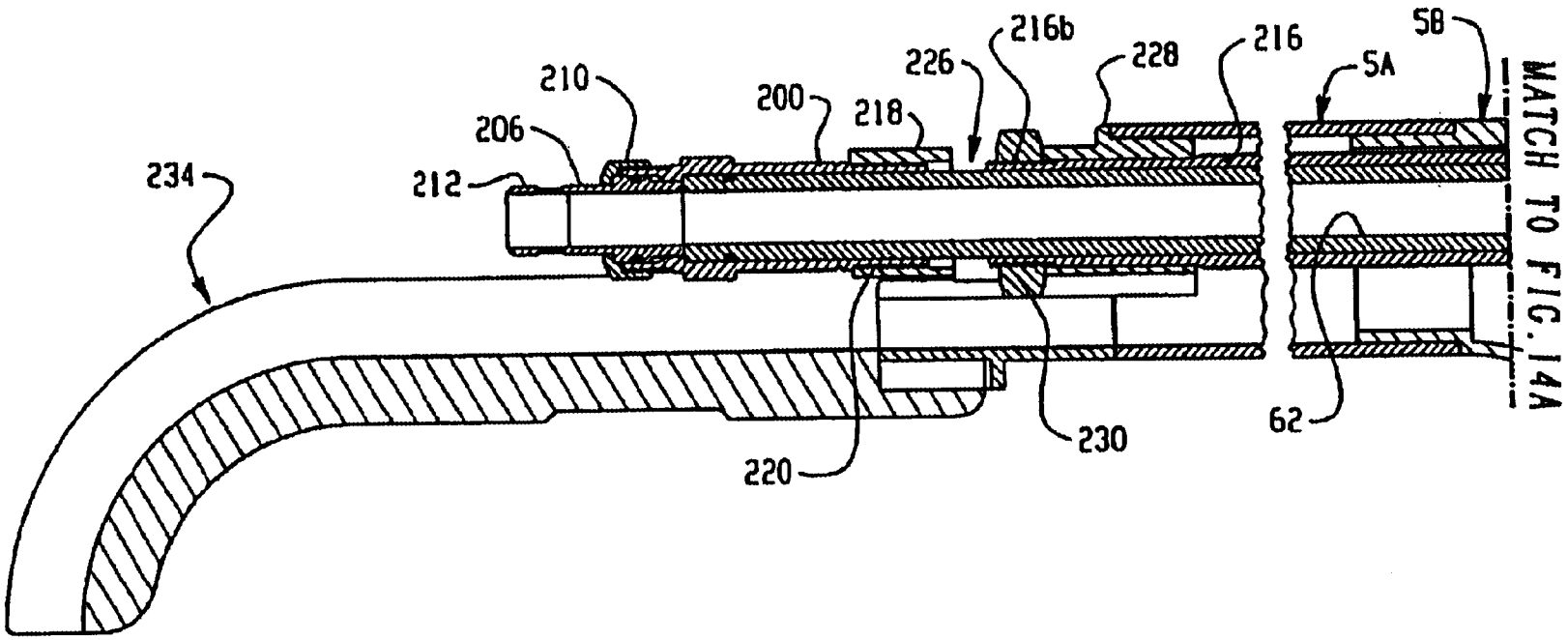
Figure 15A:
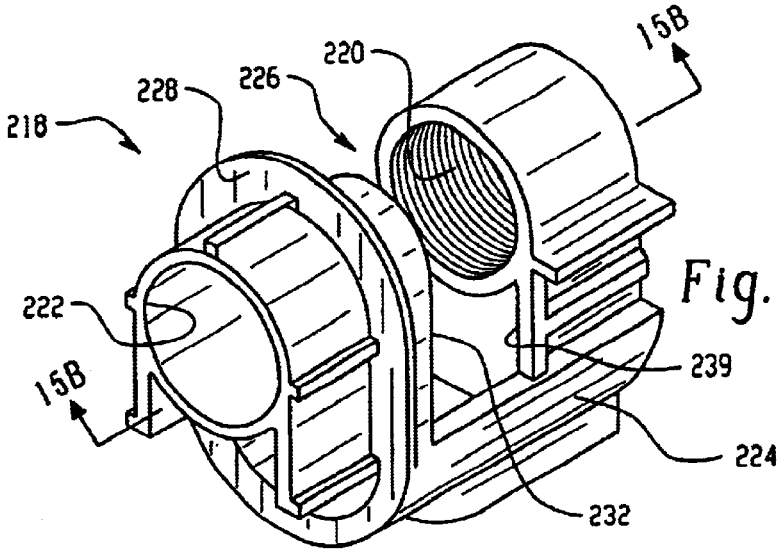
FIGS. 15A and 15B illustrate a tube inlet bracket.
Figure 15B:
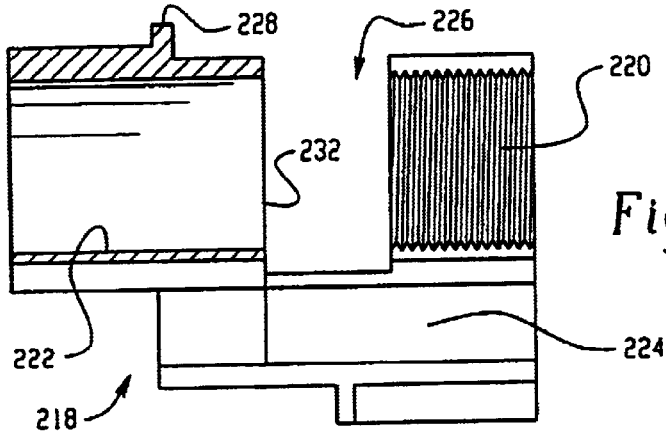

Thus, in the tube mount configuration illustrated in FIGS. 14A and 14B, a continuous straight line enclosed gap free powder path 60 is formed by the inlet hose connector 206, the powder feed tube 62, the spider 100 and the nozzle tip 108. This powder path is completely secured in axial compression by the use of externally threaded connectors that join the various segments of the path together. Furthermore, the use of the tie bar 216 in combination with the two piece housing 4, 5 provides a very rigid and strong structure that is not susceptible to loosening from vibration.

Figure 16:
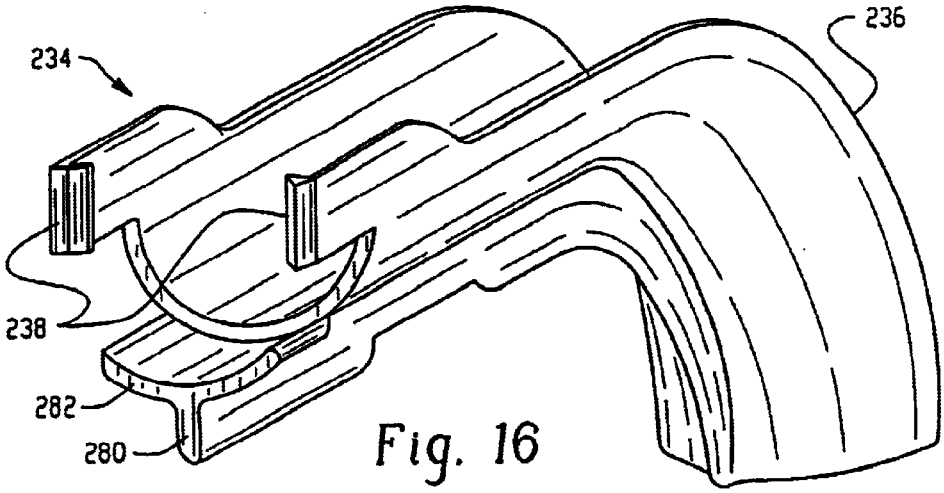
FIG. 16 illustrates a tubing support bracket shown in perspective.
Figure 16A:
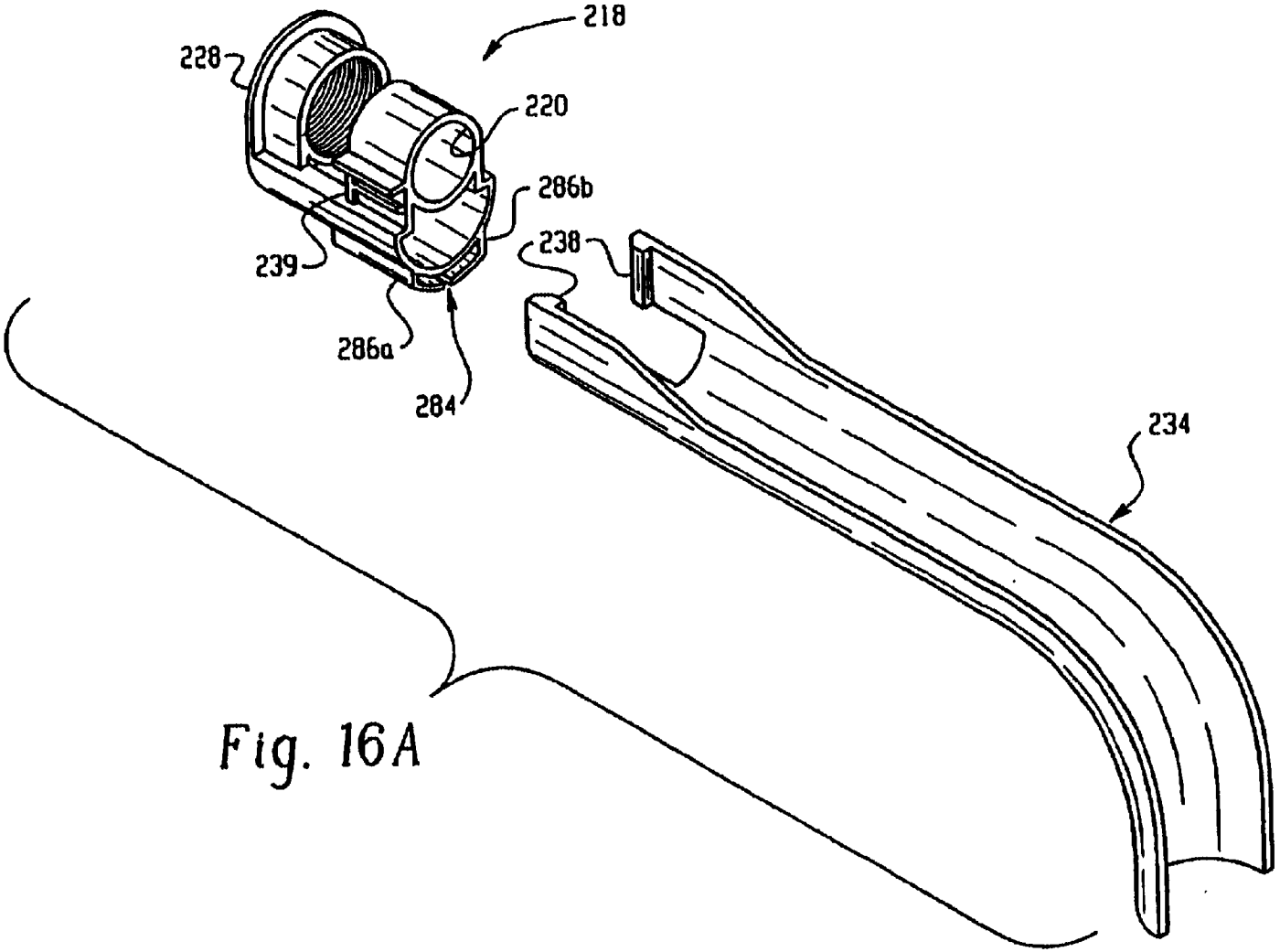
FIG. 16A illustrates the support bracket of FIG. 16 from a rear perspective and with a tube inlet bracket.

An optional tubing support bracket 234 may be releasably attached to tube inlet bracket 218. This bracket 234 (see also FIGS. 16 and 16A) provides an arcuate frame 236 that supports the powder feed hose H rearward of the powder inlet connector end 212. This support prevents an excessive bend in the powder feed hose H that could restrict the free flow of the fluidized powder into the spray gun 1. The bracket 234 includes locking tabs 238 that latch onto ribs 239 on the tube inlet bracket 218. Additional support is provided by a tongue and groove arrangement. The support bracket 234 includes a vertical rib extension 280 and a generally horizontal but somewhat arcuate tongue 282. The rib and tongue 280, 282 slide into a conforming T shaped slot 284 formed by a pair of downward extensions 286*a* and 286*b* of the tube inlet bracket 218.

Figure 17:
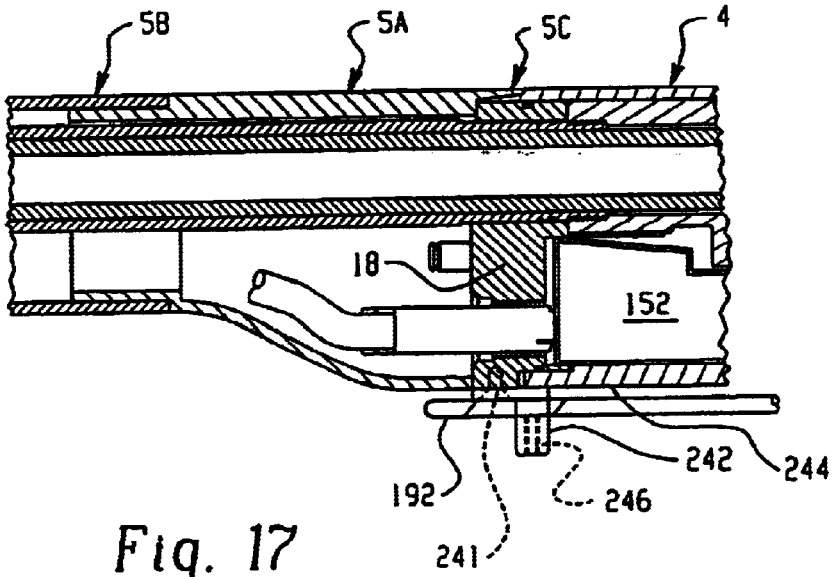
FIG. 17 is an enlarged view of the ion collector rod mounting bracket optionally used in the tube mounting configuration, shown in longitudinal cross-section.

In the tube mount configuration as previously noted the mounting bracket 19 does not include the lower extension 54 and ball mount 30. In order to install the ion collector rod 192, an ion collector mounting bracket 240 may optionally be provided (FIG. 17). This bracket 240 includes a flange 242 that extends below the main bracket body 244. The main body is attached to the bottom of the mounting bracket 19 with a screw 241, for example. The flange 242 includes a through hole and the ion collector rod 192 can be inserted into the through hole and secured to the bracket 240 with a set screw 246 or other convenient means.

VI. Gun Purge

A significant benefit of the gap free straight line powder path 60 of the present invention is that it allows for a very efficient automatic or manual gun purge cleaning operation. By automatic gun purge is meant that the spray gun control system K can connect pressurized air into the powder flow path when the gun 1 is not being used during a spraying operation. This air can blow powder residue in the powder path out the nozzle 2 of the gun 1. This can be used effectively during color changeover as well. This automatic purge function can be implemented as part of or in place of conventional manual powder purging, the latter often being implemented by disconnecting the powder feed hose H from the gun 1 and using an air blast from an air nozzle to blow air down the powder feed tube.

In accordance with this aspect of the invention, an automatic gun purge kit can be provided as an optional feature of the gun 1. Of course, the gun purge feature could also be included as a standard feature of the gun 1.

Figure 18:
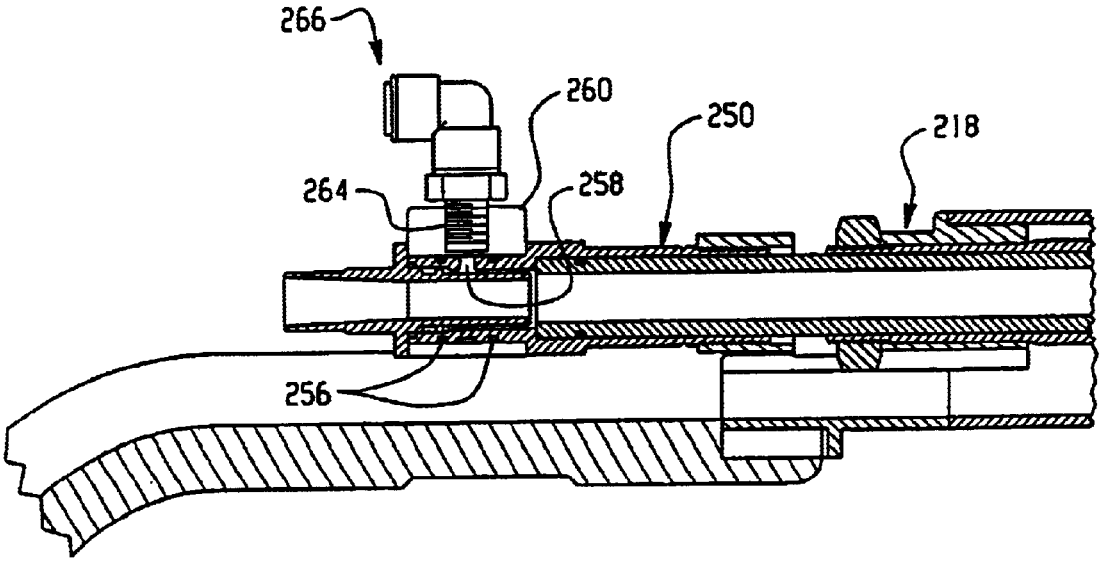
FIG. 18 is a gun purge assembly in accordance with the invention illustrated in longitudinal cross-section as installed on a spray gun.
Figure 19:
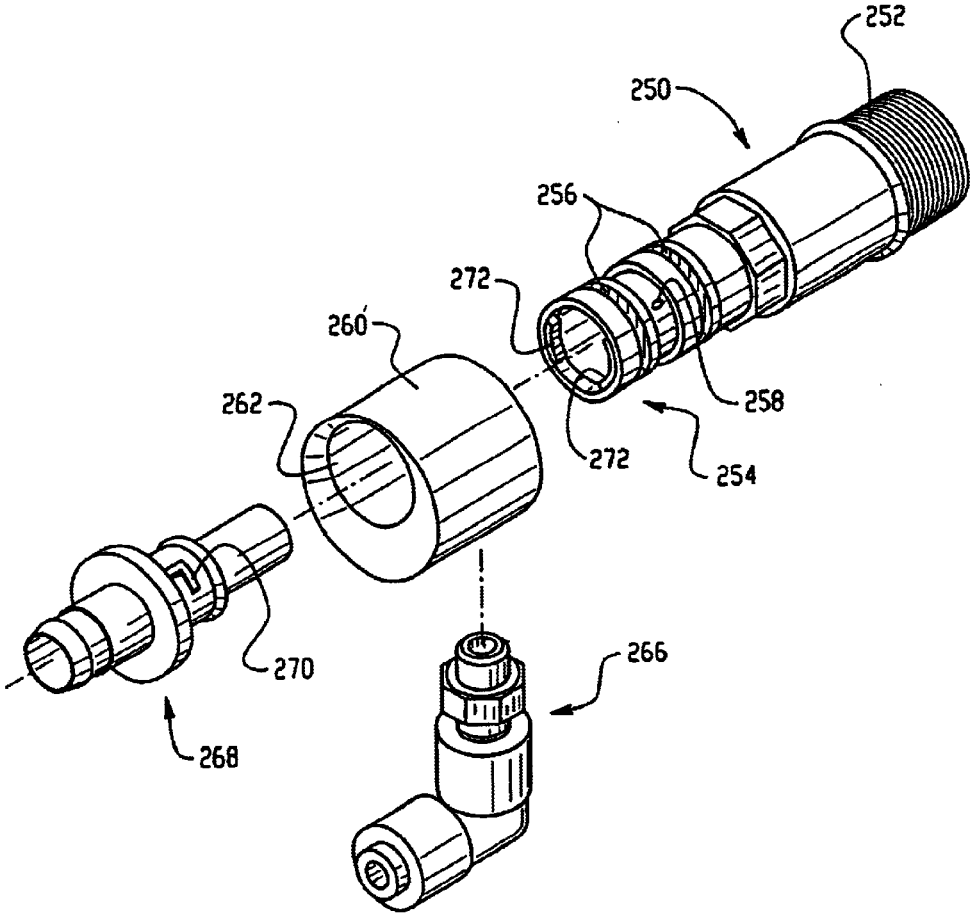
FIG. 19 is an exploded perspective of the gun purge apparatus of FIG. 18.

The gun purge function can be readily implemented by changing only a few parts of the gun 1 assembly. Furthermore, this gun purge feature can be implemented in a similar manner for both the bar mount and tube mount configurations, therefore, the apparatus will only be described once herein. The principal component that is changed is the powder tube lock nut 200. The modified parts are illustrated in FIG. 19 and as installed in FIG. 18. A modified powder tube lock nut 250 includes a threaded forward end 252 that is threadably seated in the threaded bore 220 of the tube inlet bracket 218 for the tube mount configuration and in the threaded back end 66 of the housing insert 64 for the bar mount configuration. Opposite the threaded end 252 is a reduced diameter nipple 254 having two axially spaced o-rings 256. One or more holes 258 extend radially through the wall of the nipple end 254 between the two o-rings 256.

A purge housing 260 is slideably received onto the nipple 254 as illustrated in FIG. 19. The housing 260 includes a central passageway 262 that forms an air chamber within the housing 260 and in particular axially between the o-rings 256. A threaded bore 264 receives a standard air fitting 266 to which an air line can be pushed on or otherwise conveniently connected thereto. The bore 264 opens to the air chamber within the housing 260. Thus, an air passage is provided from the fitting 266 through the housing 260 then through the hole 258 into the powder flow path within the lock nut 250. In this manner, pressurized air can be automatically fed into the powder path. The housing 260 is a slip fit installation by two o-rings 256 on the nipple 254 thereby allowing the air fitting to be rotated to any convenient position (shown in the twelve o'clock or up position in FIG. 18).

A hose connector 268 is inserted into the back end of the housing 260 and extends into the nipple 254 interior. The connector 268 can be provided with a "turn to lock" latching feature 270 that mates with latching ribs 272 on the back end of the nipple 254. Alternatively, the connector 268 can be threadably attached to the lock nut 250.

Figure 21:
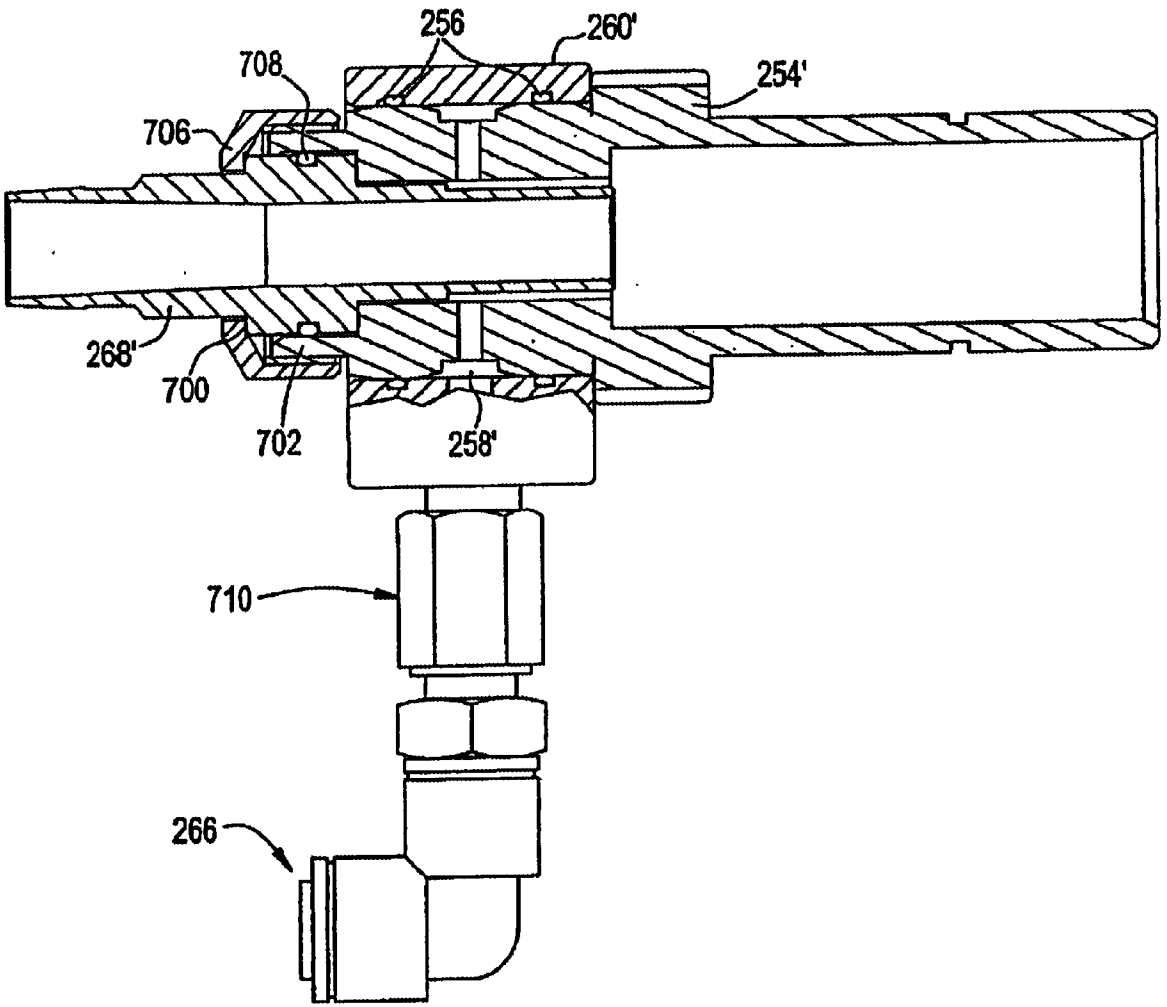
FIG. 21 is an alternative embodiment of the gun purge assembly of FIGS. 18 and 19

FIG. 21 illustrates an alternative embodiment of the gun purge assembly. In this embodiment, the housing 260' includes two grooves that retain the o-rings 256. By moving the o-rings 256 onto the housing 260', damage to the o-rings from the hole 258' is prevented.

In this embodiment, the hose connector 268' has been modified so as to use a pull up installation rather than a threaded or keyed connection. The connector 268' includes an outer shoulder 700. The nipple 254' is also slightly modified to include a threaded male end 702 at the back end thereof. A lock nut 704 is threadably installed on the threaded end 702 and includes an inward flange 706 that engages the shoulder 700 and pulls up the connector 268' securely as the nut 706 is tightened. An o-ring 708 is used to prevent reverse powder and air flow from the purge operation. This o-ring is also used on the embodiment of FIGS. 18 and 19 though not labeled.

Also added in the embodiment of FIG. 21 is a conventional in-line check valve 710. The check valve 710 is disposed between the air fitting 266 and the housing 260'. The check valve 710 prevents the reverse flow of air and powder past the fitting 266 when the purge function is not being used. The check valve may be conventional, such as part no. CVF N1-N1BU available from PISCO Pneumatic Equipment.

VII. Assembly and Disassembly of the Spray Gun

In the tube mount configuration, assembly of the gun can be carried out in the following exemplary manner. The cartridge valve 150 is seated in the housing insert 64, and then the housing insert is snap fit installed in the main gun housing 4. The multiplier 152 is inserted until the wire 160 makes firm contact with the cartridge multiplier contact 156. The gasket 182 and the mounting bracket 19 are then slid into the gun housing 4. Preferably the gasket 182 is glued to the forward end of the bracket 18, so that the gasket is removed and remains with the bracket 19 upon later disassembly. The air and electrical lines are then run through the mount tube 5 and connected to their respective terminals. The tie bar 216 is threaded into the back end of the housing insert 64. The mount tube 5 is then pushed onto the back end of the gun housing 4 and the bracket 218 installed on the back end of the tie bar 216. The tension nut 230 is then tightened onto the tie bar 216 thus pulling up the mount tube 5 to the gun housing 4 and in tight compression. Next the powder tube 62 is inserted into the gun housing 4 by running it through the tie-bar 216. Then the lock nut 200 is threaded into the tube inlet bracket 218 to put the powder tube 62 in tight compression with the housing insert 64. The hose coupling 206, the hose support bracket 234 and related components can then be installed, with or without the purge feature.

A significant feature of the invention is that the powder feed tube 62 can be one of the last components installed. The tie bar 216 securely and rigidly holds the gun 1 together with or without the powder feed tube 62 installed. Thus, during a color changeover, the powder tube 62 can be withdrawn from the gun 1 without having to disassemble the gun 1 from its mount. This also permits the powder tube 62 to be removed without the operator having to enter the spray booth. With the smooth straight line gap free powder path 60, purge cleaning is very effective, thus permitting easy interchange of the powder feed tube.

At the forward end of the gun 1, the electrode 6 is installed in the electrode holder 24, which is then seated in the spider 100. The spider 100 is then pushed into the front end of the housing insert 64 to make electrical contact with the cartridge contact 158 to provide electrical continuity from the multiplier 152 to the electrode 6. Finally, the nozzle tip 108 is slipped onto the forward end of the spider 100 and then the nozzle lock nut 112 is tightened onto the forward end of the gun housing 4.

For the bar mount configuration, the gun 1 assembly is substantially the same. After the mounting bracket 18 is screwed into the housing insert 64, the end cap 188 is installed. The ball mount 30 can then be installed into the clamp assembly 26, 28.

VIII. Alternative Designs of the Tube Mount Configuration

With reference to FIGS. 20A–D, we illustrate additional embodiments of that aspect of the invention related to the tube mount configuration as described hereinbefore. One of the basic concepts of the use of the tie-bar 216 (see FIG. 14A, for example) is to provide a mechanism that rigidly holds the two housing sections 4 and 5 together in axial compression without the need for a third housing piece or similarly weak connection. This axial compression can be realized in a number of ways, however, and are described hereafter. In the various alternative embodiments, the basic gun structure is the same as for the embodiment of FIGS. 14A,B and need not be repeated, with like parts being designated with the same reference numerals for the embodiments described hereinbefore.

Figure 20A:
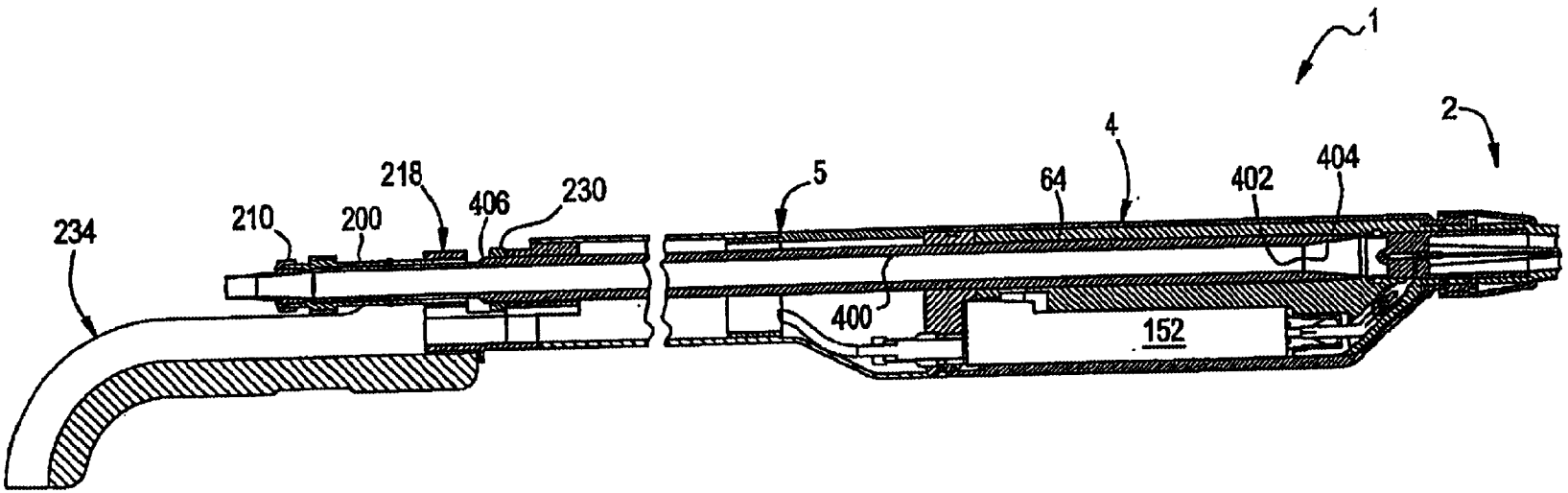
FIGS. 20A–D illustrate alternative designs for the tie-bar configuration.

In the embodiment of FIG. 20A, the feed tube has been modified to now function as both a feed tube 400 and the tie-bar. To effect this result, the forward end of the feed tube 400 is provided with a male threaded end 402. This end 402 is installed into a female threaded portion 404 of the housing insert 64. Near the back end of the feed tube 400, in the area of the tube inlet bracket 218, the feed tube 400 is provided with external threads 406. These threads mate with the tension nut 230.

For assembly, the gun 1 is assembled as in the above described embodiments, except that the feed tube 400 is threaded into the housing insert 64. After the bracket 218 is installed, the tension nut 230 is tightened onto the feed tube 400, which causes the nut 230 to push on the bracket 218 which axially compresses the housing sections 4 and 5 together.

Those of even ordinary skill in the art will readily appreciate that the feed tube 400 can be threadably engaged at any convenient location within the housing insert 64, and may also be threadably inserted into the back end of the electrode support (spider) 100.

Figure 20B:
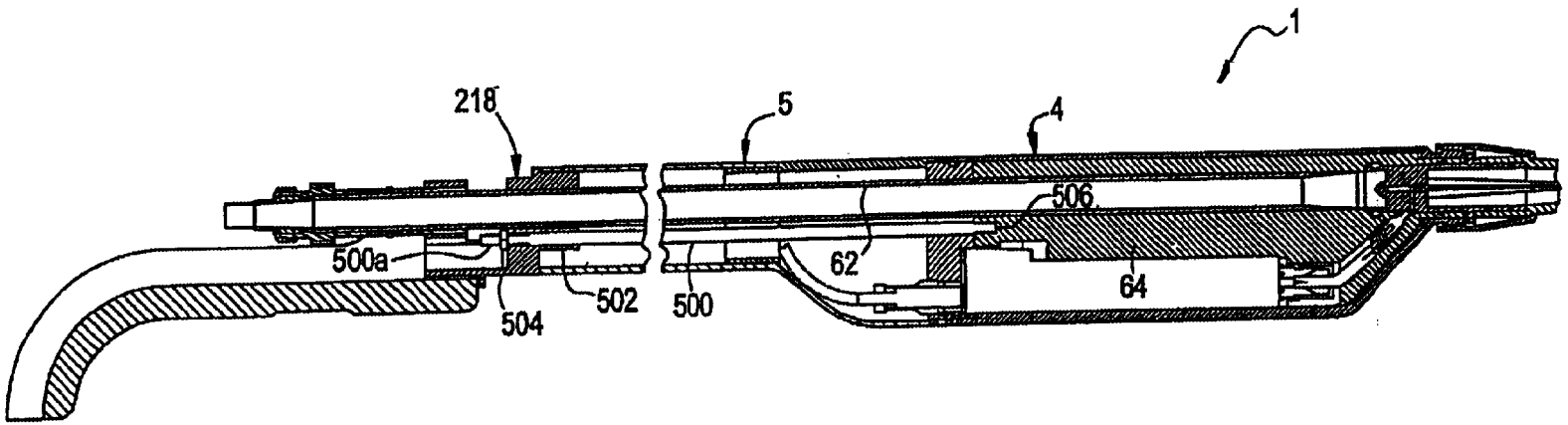

With reference to FIG. 20B, in this embodiment a small diameter rigid tie rod 500 is used to axially compress and hold the two housing sections 4 and 5 together. The rod 500 is threaded at each end thereof. The rod 500 forward end is installed into a threaded hole 506 at the back end of the housing insert 64. The tie rod 500 extends axially rearward generally parallel with the feed tube 62. The back end 500*a* of the tie bar 500 is threaded and extends through a hole 502 in the tube inlet bracket 218. A nut 504 is threaded onto the rear end of the tie rod 500. As the nut 504 is tightened, it presses against the bracket 218, which in turn axially compresses the two housing sections 4 and 5 together, in a manner similar to the embodiment of FIGS. 14A,B. Preferably, but not necessarily, the tie rod 500 extends generally along the central longitudinal axis of the gun 1, however, the rod 500 can also be off-axis and still function to hold the gun 1 together in axial compression.

Figure 20C:
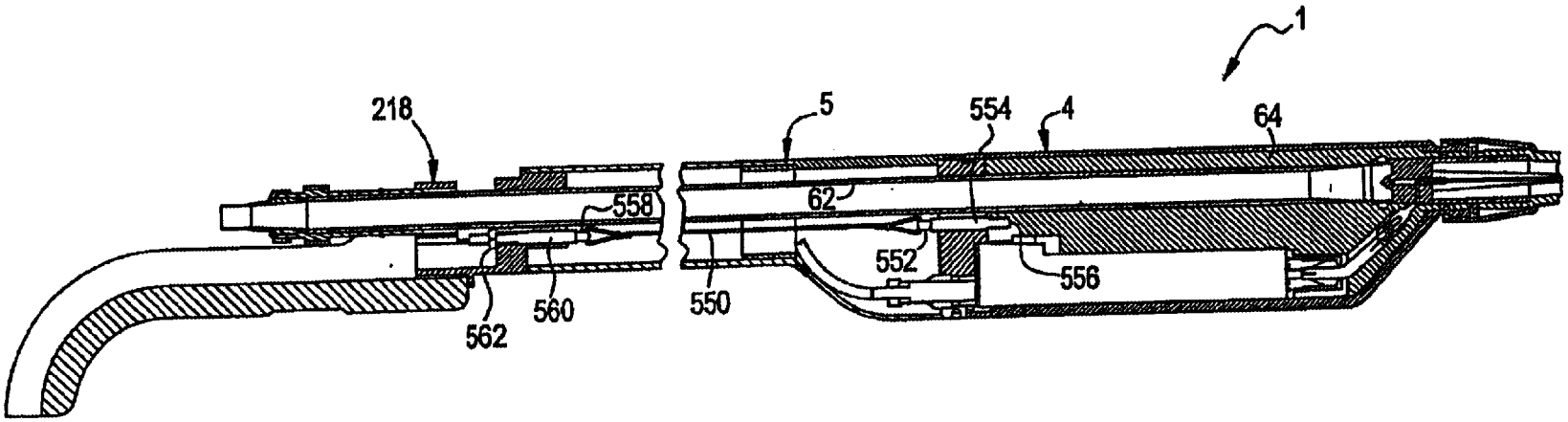

With reference to FIG. 20C, instead of a single tie bar as in FIG. 20B, a cable 550 is used. An eye bolt 552 and mount 554 are installed at the rearward end of the housing insert 64. The eye bolt 552 is formed with or attached to the mount 554, and the mount 554 has a threaded end that is installed into a threaded hole 556 in the housing insert 64. The forward end of the cable 550 is looped and can be slipped onto the eye bolt 552. A second eye bolt 558 is attached or otherwise secured with a second mount 560. The second mount 560 extends through the tube inlet bracket 218 and includes a threaded back end that receives a nut 562. The cable 550 has a loop at the back end thereof that is slipped onto the second eye bolt 558. As the nut 562 is tightened onto the second mount 560, the cable 550 is placed in tension and is used to hold the-gun housing sections 4 and 5 together in axial compression in a manner similar to the earlier described embodiments herein.

Figure 20D:
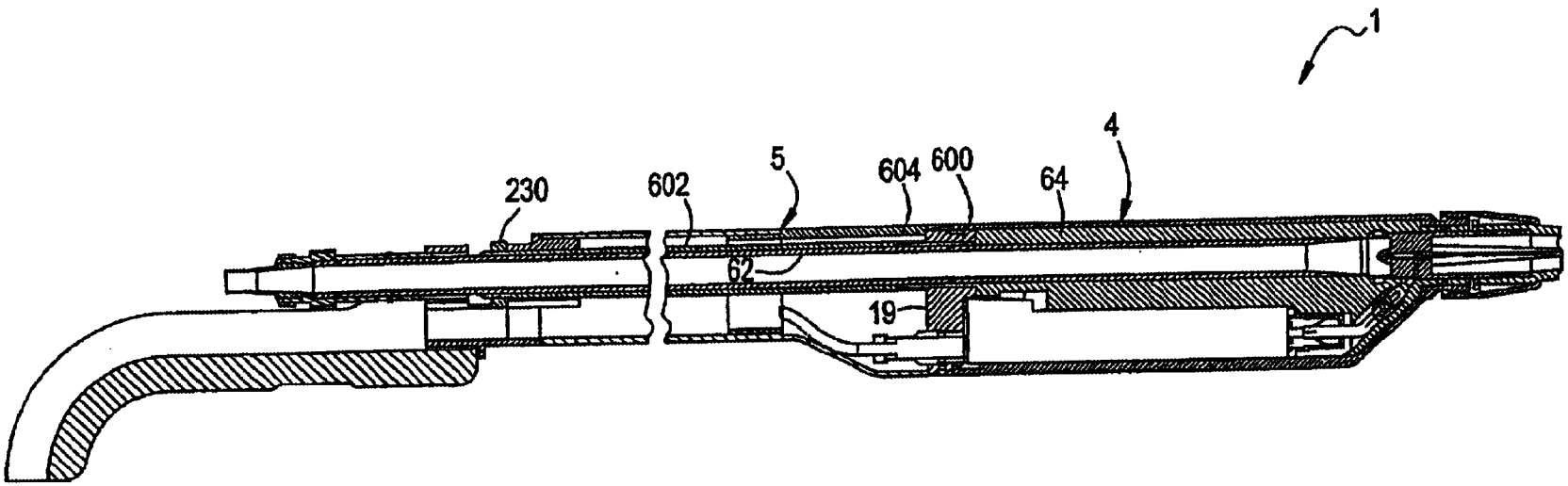

With reference to FIG. 20D, this embodiment is similar in most respects to the embodiment of FIGS. 14A and B, except that the housing insert 64 includes a threaded male extension 600. This extension 600 extends axially rearward through the mounting bracket 19. In this embodiment, rather than installing the tie-bar at the rear end of the housing insert 64 within the gun housing 4, now the tie-bar 602 includes a threaded female forward end 604 that is installed on the threaded end of the housing insert extension 600. The forward end of the tie-bar 602 engages the mounting bracket 19 and helps hold in it place, although the bracket 19 is still fully contained within the gun housing 4 and is not attached to the housing 4, the extension 5 or the housing insert 64.

The tie-bar 602 closely surrounds the feed tube 62 in a manner similar to FIGS. 14A,B. The rearward end of the tie-bar 602 is threaded and the tension nut 230 is used to pull the housing sections 4, 5 into axial compression as in the earlier described embodiments herein.

IX. Further Alternative Embodiments

Figure 22:
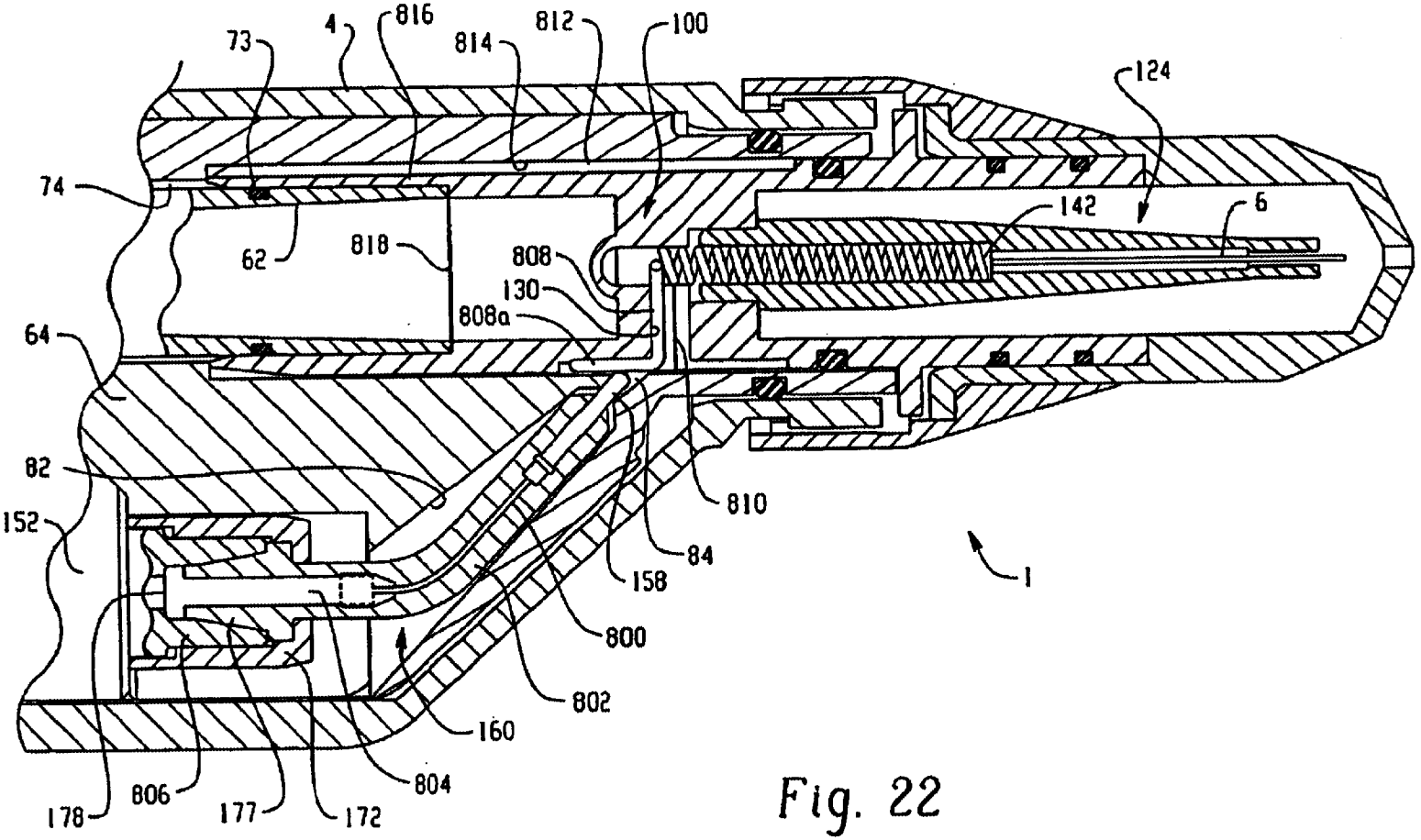
FIG. 22 is similar to FIG. 8A but illustrating several alternative embodiments.

With reference to FIG. 22, we illustrate several modifications that may be incorporated into the spray gun 1. These modifications may be used alone or in various combinations with other aspects of the invention, and may be used with the tube mount or bar mount configurations.

In FIG. 22, the cartridge assembly 150 has been omitted and in its place the multiplier output wire 160 has been lengthened to extend from the multiplier contact 178 to the opening 84 in the housing insert 64. The wire 160 is modified in this embodiment by being made as a flexible assembly. The wire assembly 160 includes a brass wire 800 that is molded in a sleeve 802 made of a soft material such as PVC for example. At one end the wire 802 is joined such as by welding to a suppression resistor 804 which preferably is also molded in the sleeve 802. The opposite end of the resistor 804 is joined to an electrical contact 806 that is electrically coupled to the multiplier 152 output 178 via a nut 172 and a flanged ferrule 177 assembly such as was described herein with reference to FIG. 8A. In this case the ferrule 177 is integrally molded as part of the sleeve 802. The wire assembly 160 is installed on the multiplier 152 prior to inserting the multiplier 152 into the housing 4. The flexible wire 160 easily passes through the angled or curved bore 82. At its opposite end, the wire 800 is welded or otherwise joined to a contact pin 158. The pin 158, as noted herein before, slightly extends through the housing insert opening 84. The flexible output wire 160 has sufficient inherent "spring" like quality to allow the contact 158 to make electrical contact with the electrode 6 as the spider 100 is inserted into the bore 74 of the housing insert 64.

The spider 100 has also been somewhat modified in the embodiment of FIG. 22. The spider 100 still retains the electrode holder 124 with the main electrode 6 and the spring extension 142 extending therethrough. However, as compared to FIG. 8A, the pin 132 has been replaced with a somewhat rigid but bendable wire 808 that extends through the spider bore 130 and contacts the spring wire 142 at one end. A second bore 810 is also provided for allowing air to pass into the electrode holder 124.

The wire 808 extends through the bore 130 and then bends to an axially extending portion 808*a*. the axially extending portion 808*a* is positioned in the area where the contact 158 extends through the opening 84 in the housing insert. By having a portion of the wire 808 extend axially, the wire 808 is more easily assured of making contact with the contact pin 158 as the spider is axially inserted into the housing insert bore 74.

A further modification of the spider 100 is that the keyed arrangement is now positioned at the top of the spider opposite the contact wire 808. In the embodiment of FIG. 8A, the housing insert included a rib 136 that was keyed to a slot 134 in the spider 100. In the modified embodiment, the spider 100 has an axially extending rib 812 formed thereon that keys into an axially extending slot 814 formed in the housing insert 64. This assures that the spider 100 is properly aligned when inserted so that the contact 158 and wire 808 are assured of making good electrical contact.

In a still further modification illustrated in FIG. 22, the rib 70 (see FIGS. 8A and 9B) of the housing insert 64 has been eliminated, and the spider 100 now includes an axially collar 816. The forward end of the powder feed tube 62 pilots into the collar 816 and abuts a shoulder or counterbore 818 formed therein. An advantage of this design is that the powder tube 62 may be inserted into the spider 100 and the tube/spider assembly inserted into the gun from the front end. Thus, the assembler has the option of inserting the powder tube 62 into the gun from the back end of the gun 1 or the front end. This design also eliminates one joint (see shoulder 70*b* in FIG. 8A) in the powder flow path. An o-ring 73 is still provided to seal the coupling of the spider 100 and the powder feed tube 62.

Figure 23:
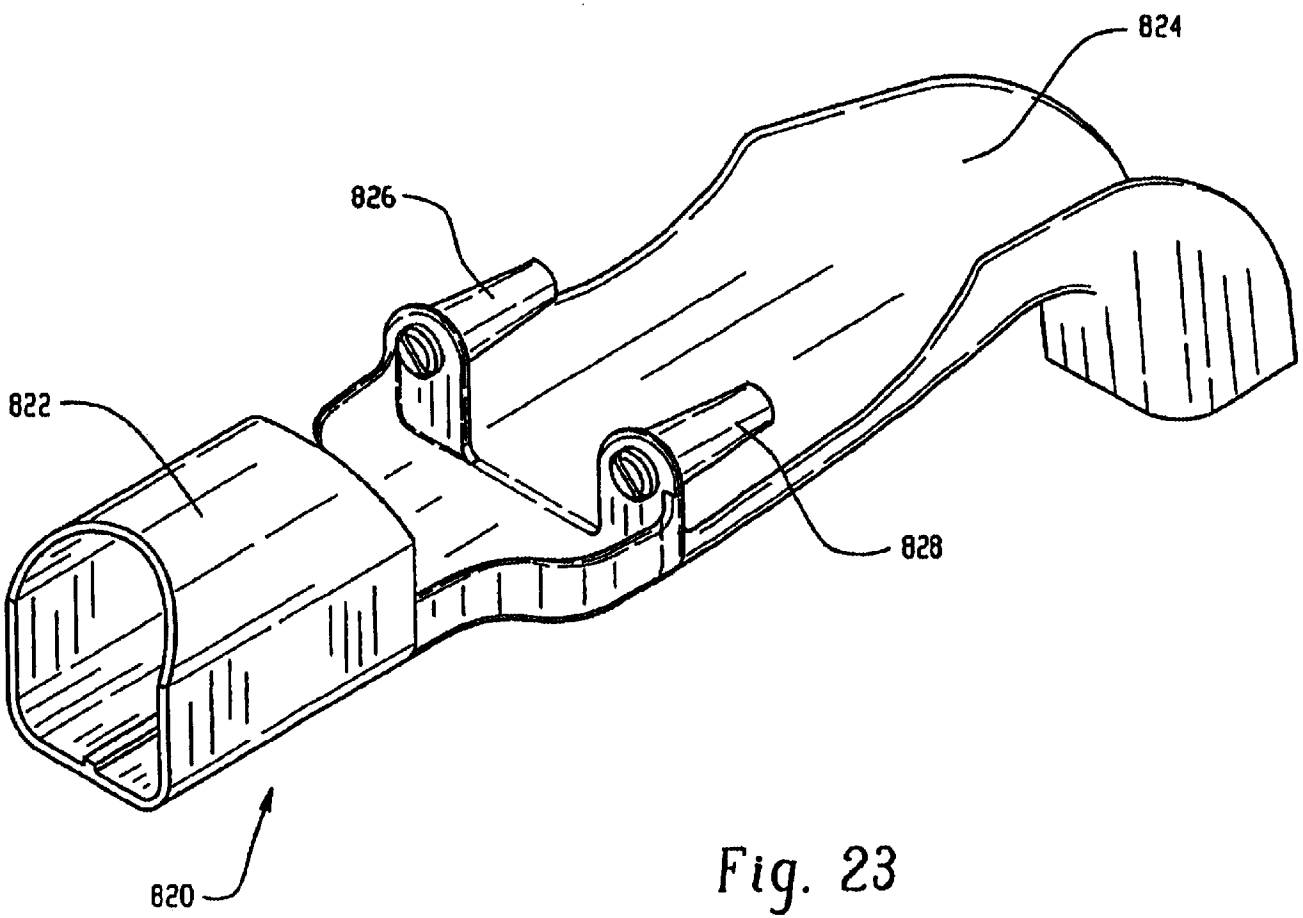
FIGS. 23 and 24 illustrate an alternative embodiment of a tube support bracket.
Figure 24:
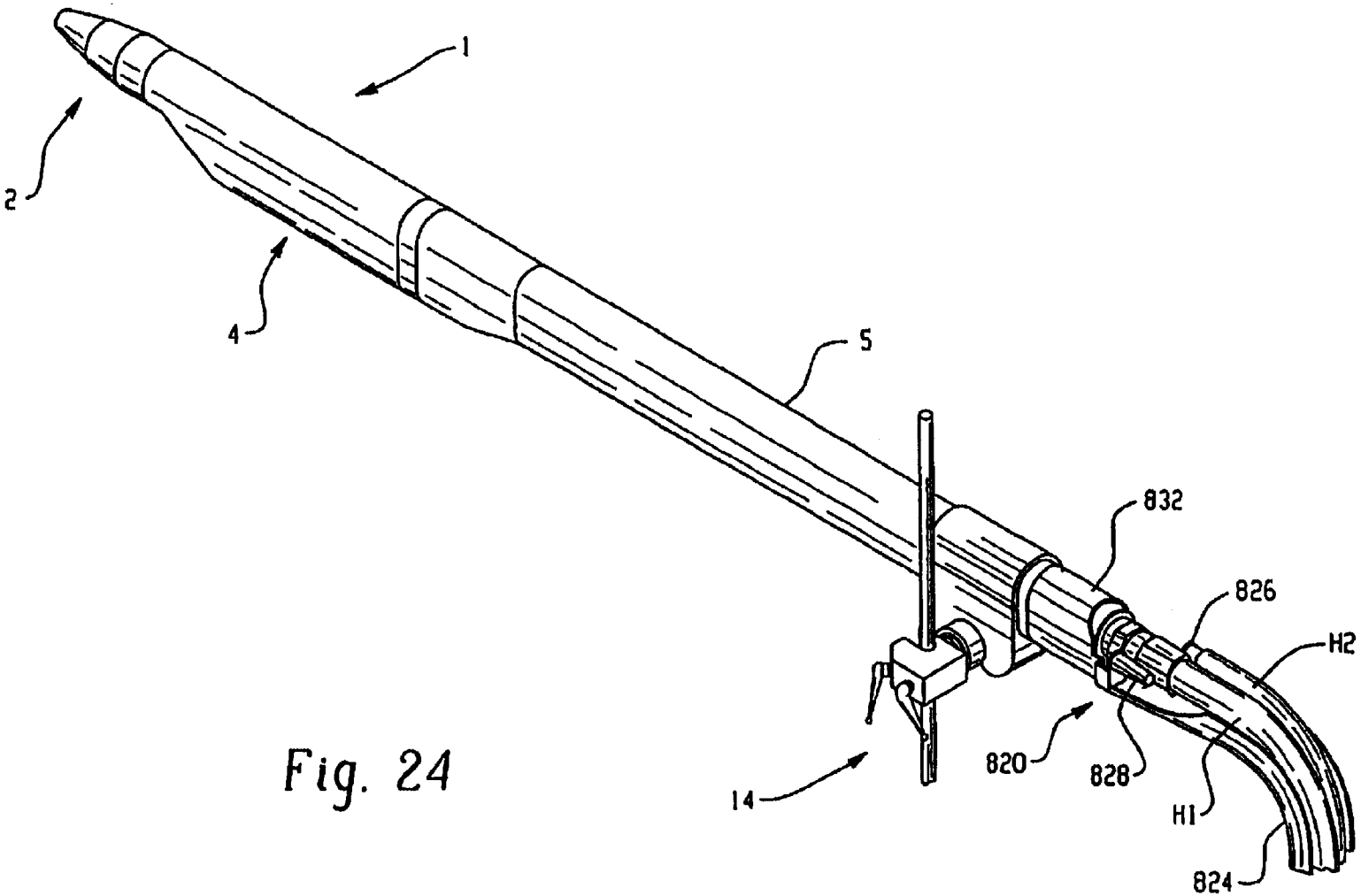

In some powder spray systems, it is desired to quickly change powder color. The present invention provides a gun design that can be easily purged and cleaned. Often times it is desired to run two powder feed hoses H up to the gun for quicker changeover. With reference to FIGS. 23 and 24, a modified tube support bracket 820 is illustrated. This bracket 820 includes a forward end having a generally tubular body 822 that is appropriately dimensioned to slip snugly onto the back end of the elongated mount tube 5. The shape of the body 822 will be selected to conform to the contour of the gun housing 5 for an easy slip fit installation. The bracket 820 further includes a rearwardly extending and downwardly curved tray 824 that supports the powder hoses H1 and H2. In this example, hose H1 is connected to powder tube connector end 212 (FIG. 14B for example) on the spray gun 1. The hose H2 that is not being used during the current spraying operation is then plugged with a plug 826 on the bracket. For color changeover, the hoses are swapped and a second plug 828 used for hose H1.

Figure 25:
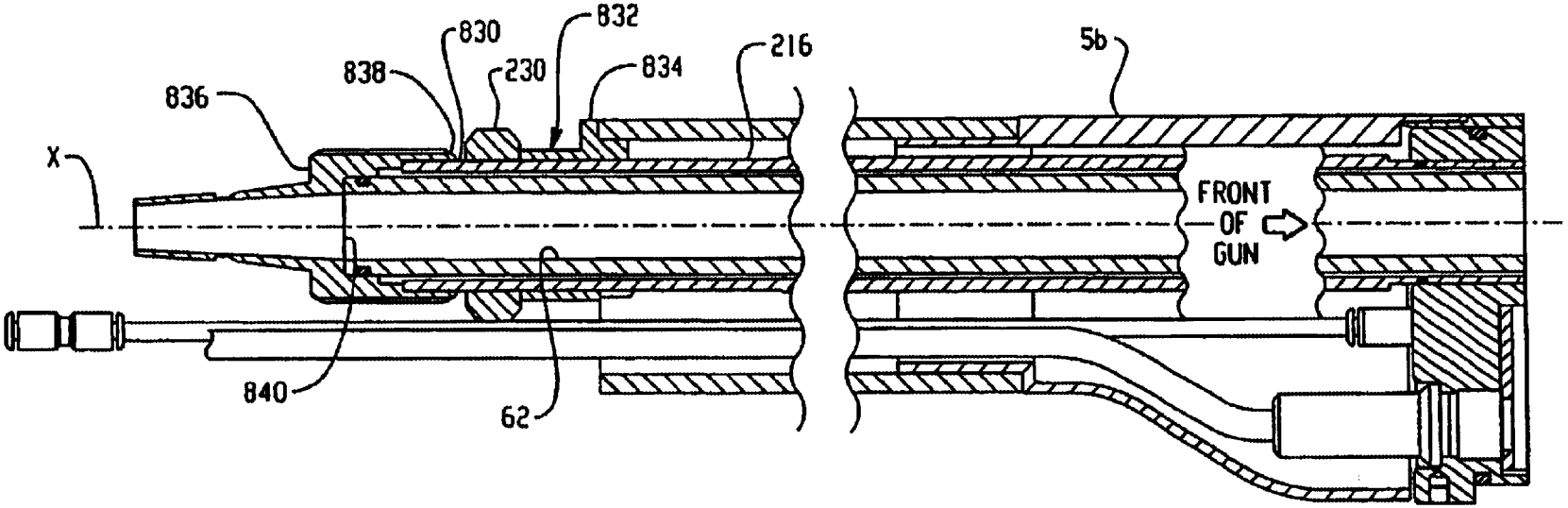
FIG. 25 illustrates an alternative embodiment for the hose and tie-bar connection.

With reference to FIG. 25, the back end of the gun 1 has been simplified by eliminating the bracket 218. In this embodiment, the tie bar 216 extends forward into and is threadably joined to the rear portion of the housing insert 64. The rear portion of the tie bar is threaded as at 830 and extends axially through a locator bracket 832. The locator 832 has an annular rib 834 that engages the back end of the mount tube 5B. the tension nut 230 is threadably installed on the tie bar 216 and tightened until the mount tube 5 and housing 4 are pulled up and held together in compression as previously described herein to form a rigid strong structure. The threaded end of the tie bar 216 extends axially rearward of the tension nut 230. A hose connector 836 includes a threaded socket 838 so that the connector maybe threadably installed on the rear end of the tie bar 216. The connector 836 includes an inner shoulder 840 that engages the rear end of the powder tube 62. As the connector 836 is threaded onto the tie bar 216, it pushes the powder tube axially forward to form a tight enclosed powder flow path, with the forward end of the powder tube 62 tightly abutting the shoulder 818 in the spider 100 (FIG. 22). This greatly simplifies purging and cleaning for color change and assembly of the gun 1.

The invention has been described with reference to the preferred embodiment. Obviously, modifications and alterations will occur to others upon a reading and understanding of this specification. It is intended to include all such modifications and alterations insofar as they come within the scope of the appended claims or the equivalents thereof.

What is claimed is:

1. A non-manual spray gun comprising: a gun housing adapted for a spray gun that is not manually held during a spraying operation, a nozzle attachable to a spray end of said housing and a powder hose attachable to a powder inlet at a back end of said housing, a gun housing extension that is joined with the back end of said gun housing and extends axially from said gun housing back end an axial length that is longer than said gun housing, with said powder hose extending through said housing extension; and a hose support bracket associated with said housing extension; said bracket comprising a downwardly curved tray supporting a powder hose when the hose is connected to said powder inlet.

2. The apparatus of claim 1 wherein said bracket supports two powder hoses, and includes support plugs, wherein during a spraying operation one of said hoses is connected to said powder inlet and the other of said hoses is attached to one of said plugs.

3. The spray gun of claim 1 wherein said support bracket includes at least one plug mounted on said bracket that is inserted into a powder hose end to plug said powder hose when said plugged powder hose is not being used to feed powder to the spray gun.

4. The spray gun of claim 1 wherein the spray gun is an automatic spray gun adapted for a tube mount or bar mount configuration without a handle for manual support of the spray gun.

5. The spray gun of claim 1 wherein said gun support is selected from one of the following: a stationary support, a reciprocating support, a gun mover.

6. The spray gun of claim 1 wherein said gun housing extension extends axially rearward from a back end of said gun housing an axial distance that is substantially greater than an axial length of said gun housing; said powder hose extending rearward from said gun housing section through said gun housing extension.

7. The spray gun of claim 6 wherein said bracket is attached to said spray gun housing.

8. The spray gun of claim 7 wherein said bracket is attached to a back end of said gun housing extension.

9. A non-manual spray gun assembly comprising: a housing assembly adapted for a spray gun that is not manually held during a spraying operation comprising a gun housing and gun housing extension that extends axially from a back end of said gun housing, a gun support, said gun housing extension being mounted on said gun support; a nozzle attachable to a spray end of said gun housing, a powder hose for supplying powder to a powder inlet of the spray gun assembly through said gun housing extension, and a hose support bracket associated with said gun housing extension housing; said bracket comprising a downwardly curved tray supporting said powder hose when said powder hose is connected to the spray gun assembly.

10. The spray gun of claim 9 wherein said bracket is installable on said gun housing extension at a back end thereof.

11. The spray gun of claim 10 wherein said bracket is installed on said gun housing extension by a snap fit or slip on arrangement.

12. The spray gun assembly of claim 9 comprising a powder feed tube that extends through said gun housing extension and wherein said powder hose is connected to an inlet end of said powder feed tube.

13. A non-manual spray gun assembly comprising: a housing assembly adapted for a spray gun that is not manually held during a spraying operation comprising a gun housing and gun housing extension that extends axially from a back end of said gun housing, a gun support means that supports said spray gun during a spraying operation, said gun housing extension being mounted on said gun support means; a nozzle attachable to a spray end of said gun housing, a powder hose for supplying powder to a powder inlet of the spray gun assembly through said gun housing extension, and a hose support bracket associated with said gun housing extension housing; said bracket comprising a downwardly curved tray supporting said powder hose when said powder hose is connected to the spray gun assembly.

14. A non-manual spray gun assembly comprising: a housing assembly adapted for a spray gun that is not manually held during a spraying operation comprising a gun housing, a gun support means that extends axially behind said gun housing an axial distance at least as long as an axial length of said gun housing, said gun housing being mounted on said gun support means; a nozzle attachable to a spray end of said gun housing, a powder hose for supplying powder to a powder inlet of the spray gun assembly, and a hose support bracket mounted on a rearward end of said gun support means; said bracket comprising a downwardly curved tray supporting said powder hose when said powder hose is connected to the spray gun assembly.

15. The spray gun of claim 14 wherein said gun support means is selected from one of the following: a stationary support, a reciprocating support, a gun mover.

* * * * *